US007441749B2

(12) United States Patent
Beaudoin et al.

(10) Patent No.: US 7,441,749 B2
(45) Date of Patent: Oct. 28, 2008

(54) CHAIN GUIDE AND DRIVE MECHANISM INCLUDING THE SAME

(75) Inventors: Michel Beaudoin, Drummondville (CA); Pierre-Louis Foucault, St-Lambert (CA); Richard Tremblay, Drummondville (CA); Vincent Roy, St-Jean-Chrysostome (CA); Helene Robert, Drummondville (CA)

(73) Assignee: Canimex, Inc., Drummondville, Quebec (CA)

( * ) Notice: Subject to any disclaimer, the term of this patent is extended or adjusted under 35 U.S.C. 154(b) by 0 days.

(21) Appl. No.: 11/635,947

(22) Filed: Dec. 8, 2006

(65) Prior Publication Data

US 2007/0145339 A1 Jun. 28, 2007

Related U.S. Application Data

(60) Provisional application No. 60/748,173, filed on Dec. 8, 2005.

(51) Int. Cl.
*B66D 3/06* (2006.01)
*B66D 1/20* (2006.01)

(52) U.S. Cl. ..... 254/403; 254/411; 254/358

(58) Field of Classification Search ..... 254/358, 254/372, 411, 402, 403
See application file for complete search history.

(56) References Cited

U.S. PATENT DOCUMENTS

| | | | | |
|---|---|---|---|---|
| 365,545 | A | 6/1887 | Sharp et al. | |
| 1,152,608 | A * | 9/1915 | Cull | 474/140 |
| 1,185,179 | A * | 5/1916 | Chattaway | 254/411 |
| 1,245,492 | A * | 11/1917 | Moore | 474/140 |
| 1,876,954 | A * | 9/1932 | Johnson | 475/175 |
| 2,704,201 | A | 3/1955 | Robins | |
| 2,773,668 | A | 12/1956 | Robins et al. | |
| 2,991,976 | A | 7/1961 | Carroll | |
| 3,030,076 | A | 4/1962 | Stevens | |
| 3,596,879 | A | 8/1971 | Clark | |
| 3,690,529 | A * | 9/1972 | Prest | 226/76 |
| 4,399,908 | A | 8/1983 | Gunti | |
| 4,560,046 | A | 12/1985 | Lorello et al. | |
| 4,792,323 | A | 12/1988 | Flaig | |
| 4,881,720 | A * | 11/1989 | Nishimura | 254/358 |
| 5,125,629 | A | 6/1992 | Nishimura | |

(Continued)

FOREIGN PATENT DOCUMENTS

| | | |
|---|---|---|
| DE | 39 09 332 C1 | 5/1990 |

(Continued)

*Primary Examiner*—Evan H Langdon
(74) *Attorney, Agent, or Firm*—Merchant & Gould P.C.

(57) ABSTRACT

A chain guide for guiding a chain within a chain hoist. The chain guide includes a substantially elongated body having an inner side and an outer side, along with first and second extremities. The substantially elongated body is made of a substantially flexible material for curving the substantially elongated body into a substantially arched configuration about a given wheel of the chain hoist. The chain guide also includes first and second chain receiving portions provided adjacent to the first and second extremities respectively of the substantially elongated body, on the inner side thereof. Each chain receiving portion comprises a pair of shoulders protruding from the inner side of the body and defining an open channel shaped and sized for slidably receiving a portion of the chain. The chain guide also includes a deformable connecting portion for interconnecting the first and second chain receiving portions of the chain guide. Also described is a chain hoist provided with the chain guide.

20 Claims, 23 Drawing Sheets

U.S. PATENT DOCUMENTS

| | | | | |
|---|---|---|---|---|
| 5,927,690 | A | 7/1999 | White et al. | |
| 6,062,543 | A | 5/2000 | Kobayasi et al. | |
| 6,381,903 | B1 | 5/2002 | Desrochers et al. | |
| 6,386,516 | B1 * | 5/2002 | Lenders | 254/393 |
| 6,450,482 | B1 | 9/2002 | Struck | |
| 6,966,546 | B2 * | 11/2005 | Winter et al. | 254/402 |
| 7,048,029 | B2 | 5/2006 | Rieder et al. | |
| 2003/0197160 | A1 * | 10/2003 | Curtis | 254/358 |
| 2004/0182528 | A1 | 9/2004 | Rieder et al. | |
| 2004/0211951 | A1 | 10/2004 | Rosati | |
| 2005/0043132 | A1 | 2/2005 | Moll et al. | |

FOREIGN PATENT DOCUMENTS

| | | | |
|---|---|---|---|
| EP | 1 457 455 | A1 | 9/2004 |

* cited by examiner

CHAIN GUIDE AND DRIVE MECHANISM INCLUDING THE SAME

FIELD OF THE INVENTION

The present invention relates to a chain guide. More particularly, and in its preferred intended use, the present invention relates to a chain guide to be used within a driving mechanism, such as chain hoists and the like, for use with an overhead shaft of a door assembly, such as garage doors and the like, typically sectional doors, for raising and lowering the given door assembly. The present invention also relates to a drive mechanism (hereinafter referred to also as "chain hoist") including such a chain guide. The present application claims priority of U.S. provisional patent application No. 60/748,173 dated Dec. 8, 2005, the content of which is incorporated herein by reference.

BACKGROUND OF THE INVENTION

Door assemblies and the chain hoists used therewith are very well known in the art. For example, U.S. Pat. No. 6,712,116 B2 granted on Mar. 30, 2004, to the Applicant/Assignee of the present application (Canimex Inc.), and naming BEAUDOIN et al. as the inventors, relates to a drive mechanism for use with an overhead shaft of a sectional door, the content of this patent being incorporated herein by reference.

Also known to the Applicant are the following US patents and patent applications which describe various chain hoists and the like: U.S. Pat. Nos. 2,704,201; 2,773,668; 3,596,879; 4,399,908; 4,560,046; 4,792,323; 5,125,629; 5,927,690; 6,381,903 B1; 6,450,482 B1; 7,048,029 B2; 2004/0182528 A1; 2004/0211951 A1; and 2005/0043132 A1.

It is also known in the art that the rapid downfall of an inappropriately counterbalanced door assembly can sometimes result in the excessive rotation of the main shaft which is intended to operatively sustain torsional springs of the counterbalancing system of the door assembly. A pocket wheel is generally operatively fixed to said main shaft and a chain is operatively suspended about said pocket wheel. As is known, the operating of this chain enables the manual raising and lowering of the door assembly. When the door descends very quickly, the chain turns, looses its tension and may be drawn outside the pockets of the chain pulley given the centrifugal force created by the rotation of the shaft. In some cases even, although very unlikely, the chain may completely come off from the chain pulley and hit against an inside portion of the chain hoist when the latter comprises a casing that contains its components. Although very unlikely also, the chain may, in very exceptional cases, become "locked" (or "jammed") in the chain hoist. This creates an important pressure on the internal components of the chain hoist which suddenly must retain the weight of the door, which is disadvantageous, for obvious reasons known in the art. Therefore, there is a substantial need to come up with an improved chain hoist and/or component to be used therewith which would be able to overcome the aforementioned prior art problem.

It is also known in the art that certain chains used in the industry of the garage door can, although very unlikely, in very exceptional cases, result in the formation of unwanted knots which may undesirably "lock" (or "jam") the chain hoist, which is disadvantageous, for obvious reasons known in the art. Therefore, there is also a substantial need to come up with an improved chain hoist and/or component to be used therewith, which would overcome the aforementioned prior art problem.

It is also known in the art that, as a result of the above-discussed, and in some circumstances, conventional chain hoists tend to be quite noisy when internal components thereof and corresponding chain cooperate adversely with each other, which is also disadvantageous. Indeed, the faster a given chain turns about a chain pulley, the greater the risk of provoking resulting vibrations in the corresponding internal components of the chain hoist. Furthermore, noise is very often amplified by the resonance of the casing (typically, a metallic casing) created by a conventional closed chain hoist, which is also undesirable.

Hence, in light of the aforementioned, there is a need for an improved device, which by virtue of its design and components, would be able to overcome some of the above-discussed prior art problems.

SUMMARY OF THE INVENTION

The object of the present invention is to provide a chain guide (and/or a drive mechanism including the same) which, by virtue of its design and components, satisfies some of the above-mentioned needs and is thus an improvement over other related devices and/or methods known in the prior art.

The present invention is particularly advantageous in that it is intended to maintain a given chain of a chain hoist within the pockets of the chain pulley when the latter is turned excessively rapidly. The present invention is also particularly advantageous in that it comprises a flexible band which is devised so as to be able to deform itself and/or allow the passage of certain knots or twists formed in the length of a given chain. Indeed, the chain guide according to the present invention is designed to be able to resist to certain impacts and/or deform itself, if need may be, as will be explained in greater details hereinbelow, and as will be better understood when referring to the accompanying drawings.

In accordance with the present invention, the above object is achieved, as will be easily understood, with a chain guide (and/or a drive mechanism including the same) such as the one briefly described herein and such as the one exemplified in the accompanying drawings.

More particularly, according to the present invention, there is provided a chain guide for guiding a chain within a chain hoist, the chain guide comprising:

a substantially elongated body having an inner side and an outer side, along with first and second extremities, the substantially elongated body being made of a substantially flexible material for curving said substantially elongated body into a substantially arched configuration;

first and second chain receiving portions provided adjacent to the first and second extremities respectively of the substantially elongated body, on the inner side thereof, each chain receiving portion comprising a first and second shoulders protruding from the inner side of the body and defining an open channel shaped and sized for slidably receiving a portion of the chain; and a connecting portion for operatively interconnecting the first and second chain receiving portions.

According to another aspect of the present invention, there is also provided a drive mechanism comprising:

a casing;

a first wheel pivotably mounted within the casing and having a bore for receiving a corresponding shaft for driving the same;

a second wheel pivotably mounted within the casing and threadedly engaged with the first wheel for driving the same;

a chain having a segment mounted about the second wheel for driving the same; and a chain guide positioned within the casing for guiding the chain within the chain hoist and about the second wheel, the chain guide comprising:

a substantially elongated body having an inner side and an outer side, along with first and second extremities, the substantially elongated body being made of a substantially flexible material for curving said substantially elongated body into a substantially arched configuration within the chain hoist and about the second wheel receiving the chain;

first and second chain receiving portions provided adjacent to the first and second extremities respectively of the substantially elongated body, on the inner side thereof, each chain receiving portion comprising a pair of shoulders protruding from the inner side of the body and defining an open channel shaped and sized for slidably receiving a portion of the chain; and a connecting portion for operatively interconnecting the first and second chain receiving portions.

According to yet another aspect of the present invention there is also provided a door assembly (e.g. a garage door) provided with the above-mentioned chain guide and/or drive mechanism.

According to yet another aspect of the present invention there is also provided a method for operating the above-mentioned chain guide, drive mechanism and/or door assembly.

According to yet another aspect of the present invention there is also provided a kit for assembling the above-mentioned chain guide, drive mechanism and/or door assembly.

According to yet another aspect of the present invention there is also provided a method for assembling components of the above-mentioned kit.

The objects, advantages and other features of the present invention will become more apparent upon reading of the following non-restrictive description of preferred embodiments thereof, given for the purpose of exemplification only with reference to the accompanying drawings.

DETAILED DESCRIPTION OF PREFERRED EMBODIMENTS OF THE INVENTION

Figure 1:
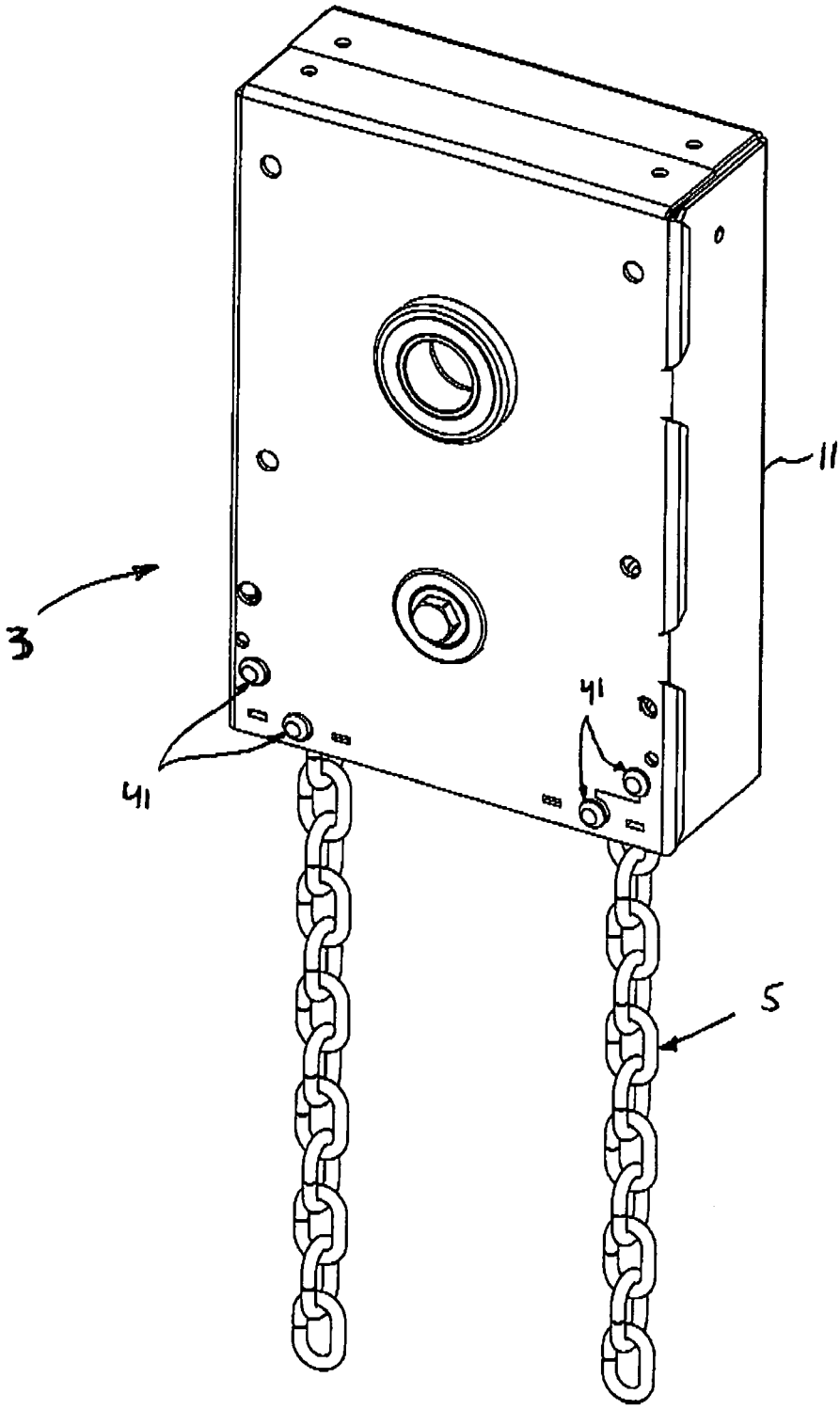
FIG. 1 is a perspective view of a chain hoist with corresponding chain, provided with a chain guide, according to a preferred embodiment of the present invention.
Figure 2:
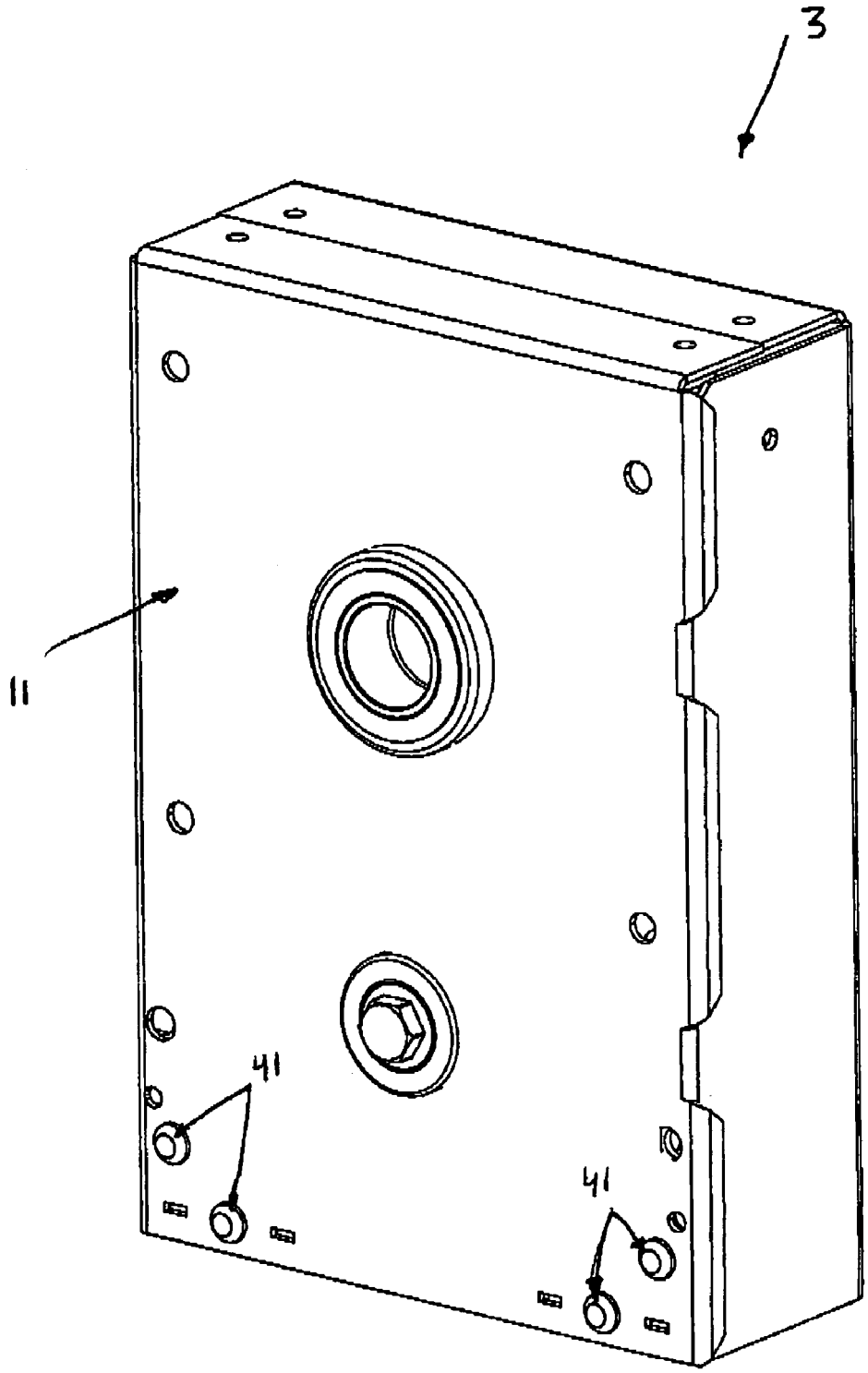
FIG. 2 is another perspective view of the chain hoist shown in FIG. 1, the chain hoist being now shown deprived of its corresponding chain.

In the following description, the same numerical references refer to similar elements. The embodiments shown in the figures are preferred.

In the context of the present description, the expression "garage door" includes all types of cable-operated or sectional doors and the like, including access openings, using one or more torsion springs for the counterbalancing the weight of the given door. Although the present invention was primarily designed for a sectional garage door, it may be used with other kinds of doors, or with any other items using a counterbalancing system or not, as apparent to a person skilled in the art. For this reason, the expression "garage door" or "sectional" should not be taken as to limit the scope of the present invention and includes all other kinds of doors or items with which the present invention may be used and could be useful.

Moreover, in the context of the present description, the expressions "garage" and "door", "torsion spring" and "torsional spring", "counterbalancing shaft" and "overhead shaft", "drive mechanism", "counterbalancing mechanism" and "counterbalancing system", as well as any other equivalent expressions and/or compound words thereof, may be used interchangeably. The same applies for any other mutually equivalent expressions, such as "plate" and "bracket" for example, as well as "drive mechanism" and "chain hoist", or even "chain", "link" and "cable", as also apparent to a person skilled in the art.

In addition, although the preferred embodiment of the present invention as illustrated in the accompanying drawings comprises various components, etc., and although the preferred embodiment of the drive mechanism 3 and corresponding parts (chain guide 1, etc.) of the present invention as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the drive mechanism 3 according to the present invention, as will be briefly explained herein and as can be easily inferred herefrom by a person skilled in the art, without departing from the scope of the invention.

Broadly described, the drive mechanism 3 and chain guide 1 to be used therewith according to the present invention, as exemplified in the accompanying drawings, is a drive mechanism 3 similar to that of a chain hoist which is typically used for operating a door assembly such as a sectional door for example, as is well known in the art. It is important to note that, according to the present invention, the chain guide 1 could also be used on a chain hoist intended for opening or closing any other type of vertical door, the doors according to the present invention being not necessarily limited to garage doors, as aforementioned and as can be easily understood by a person skilled in the art.

As also previously explained, there exist several devices which enable to correct and align as much as possible a given chain 5 of a chain hoist when the latter is entered into the pulley. However, there seems to be no device which enables to guide the chain 5 all around a given chain pulley.

As also previously explained, a garage door preferably requires to be counterbalanced in order to facilitate its opening and its closing. The counterbalancing of a door is generally ensured by at least one torsional spring which is operatively mounted about the main shaft of the door assembly. It is possible to operatively add a chain hoist operatively connected to said shaft so as to enable to raise and lower the garage door, typically in a manual manner, when the use of a mechanical operator is not appropriate. Manual chain hoists are typically used into many situations, namely: a) when a given door is very heavy and that it is very difficult to overcome the inertia of the counterbalancing springs when a person wants to open it; and b) when it is impossible for a person to completely raise a very high door.

There exist several chain hoists which differ one from the other by means of the type of components being used, the desired ratio and the utility sought out. A conventional commercial garage door with sectional panel joints does not generally require the use of a very high force ratio in order to be able to raise it. In this manner, a drive mechanism 3 (i.e. "chain hoist") according to the present invention may be used.

Figure 3:
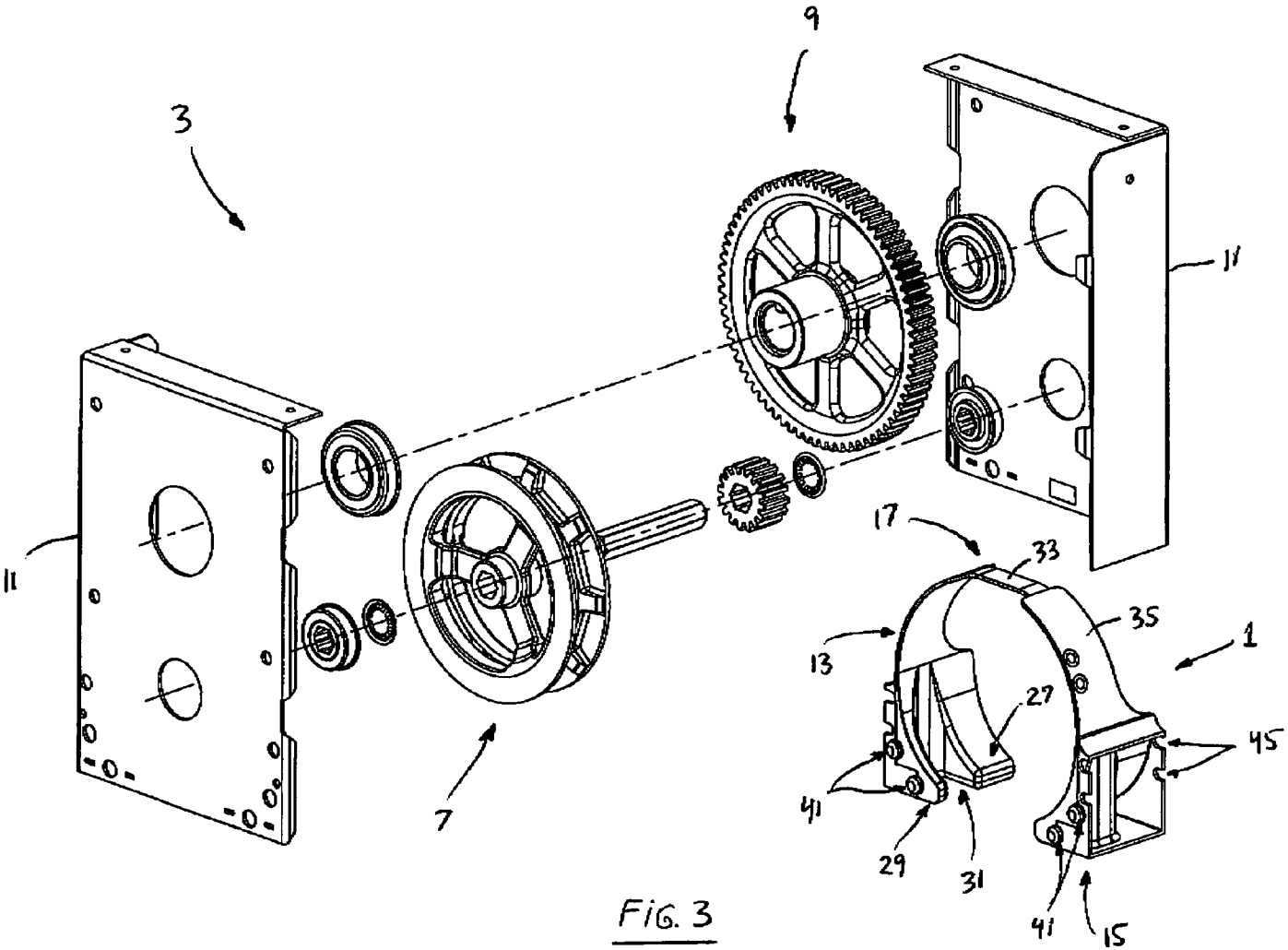
FIG. 3 is an exploded view of the components of the chain hoist shown in FIG. 2 and of the chain guide to be used therewith according to a preferred embodiment of the present invention.
Figure 4:
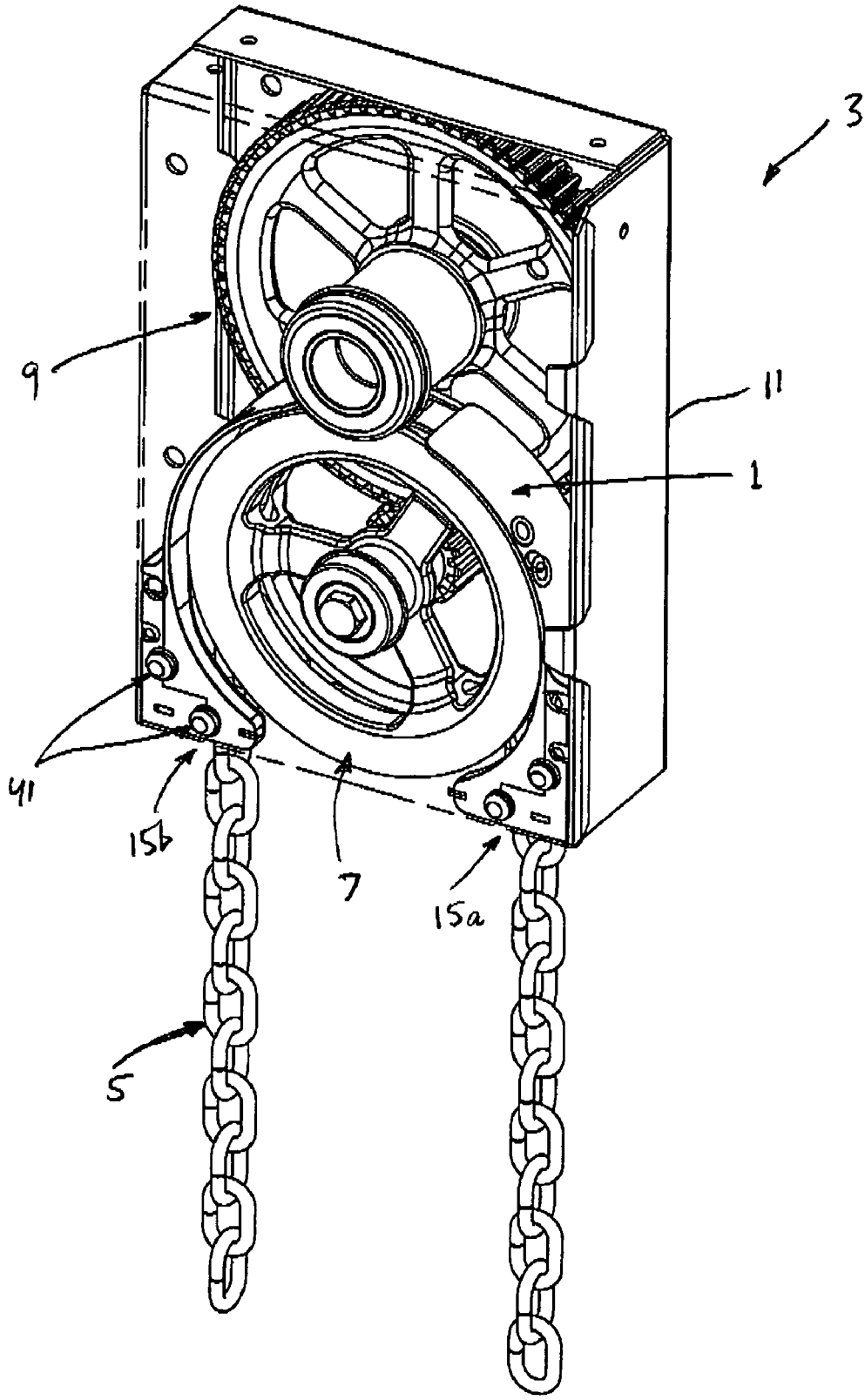
FIG. 4 is another perspective view of what is shown in FIG. 1, the chain hoist being now shown without a portion of its outer casing so as to better illustrate the inner components thereof, including chain guide according to a preferred embodiment of the present invention.
Figure 5:
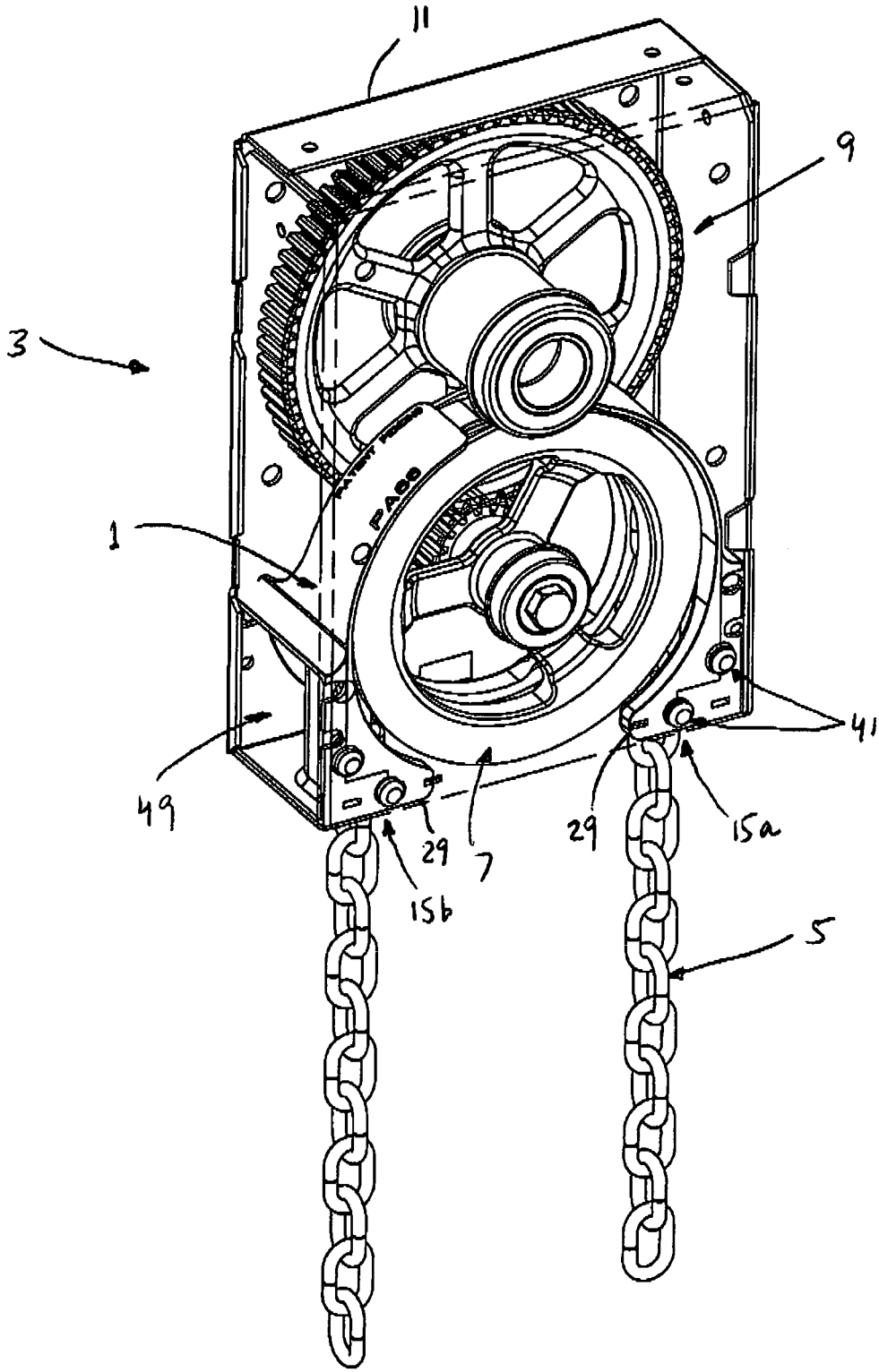
FIG. 5 is another perspective view of what is shown in FIG. 4.
Figure 6:
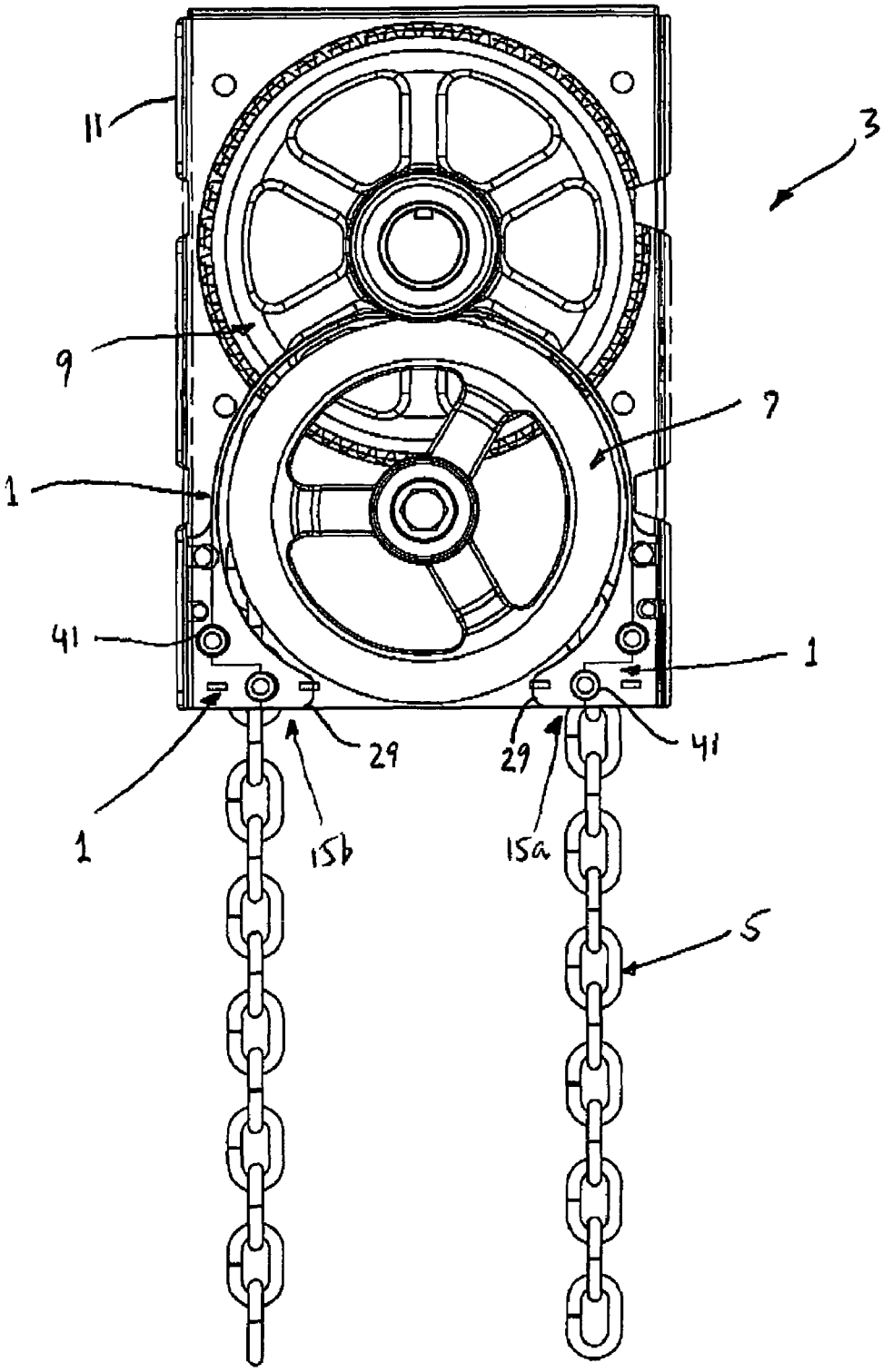
FIG. 6 is a front plan view of what is shown in FIG. 4.
Figure 7:
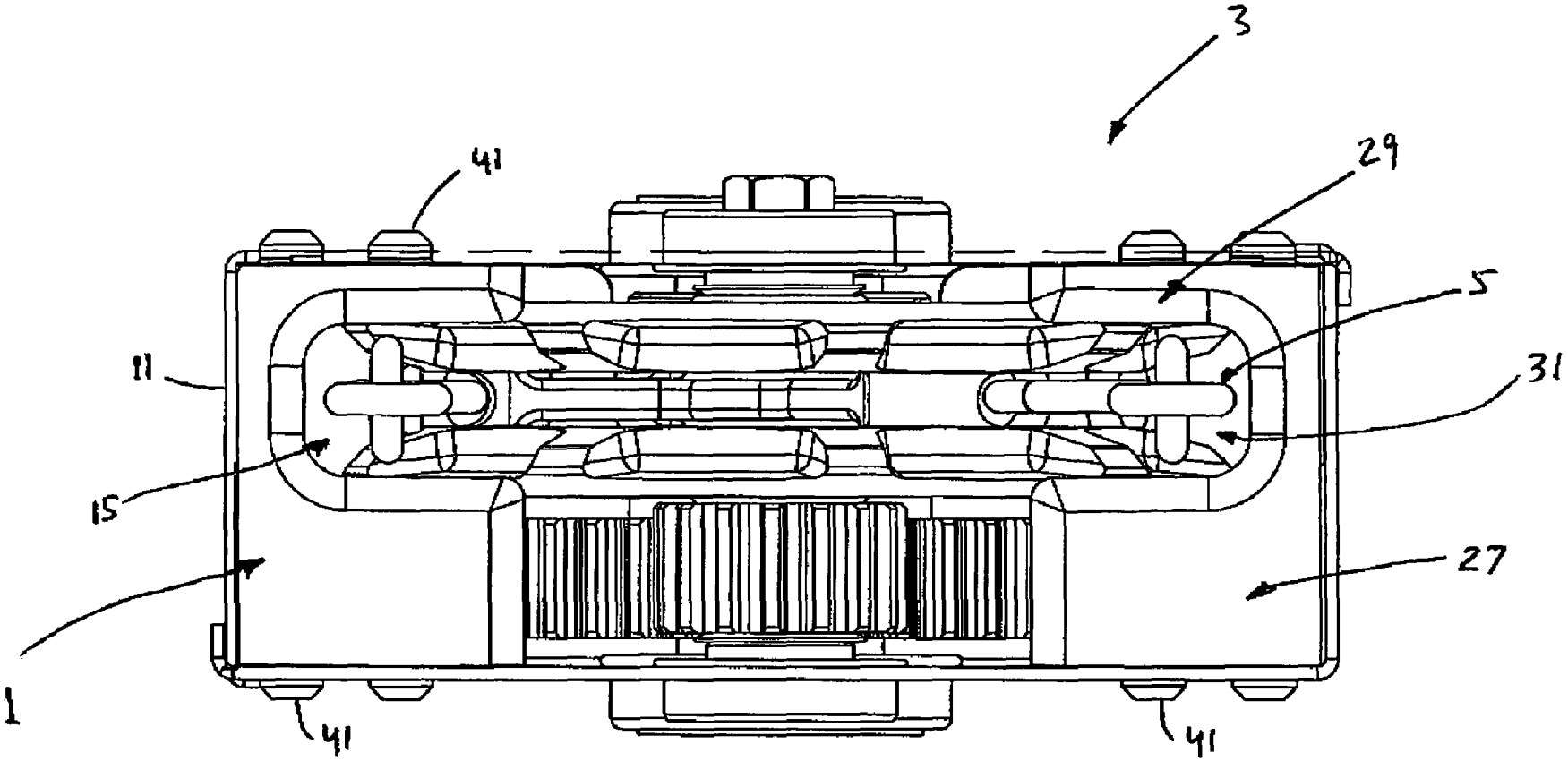
FIG. 7 is a bottom plan view of what is shown in FIG. 6.
Figure 8:
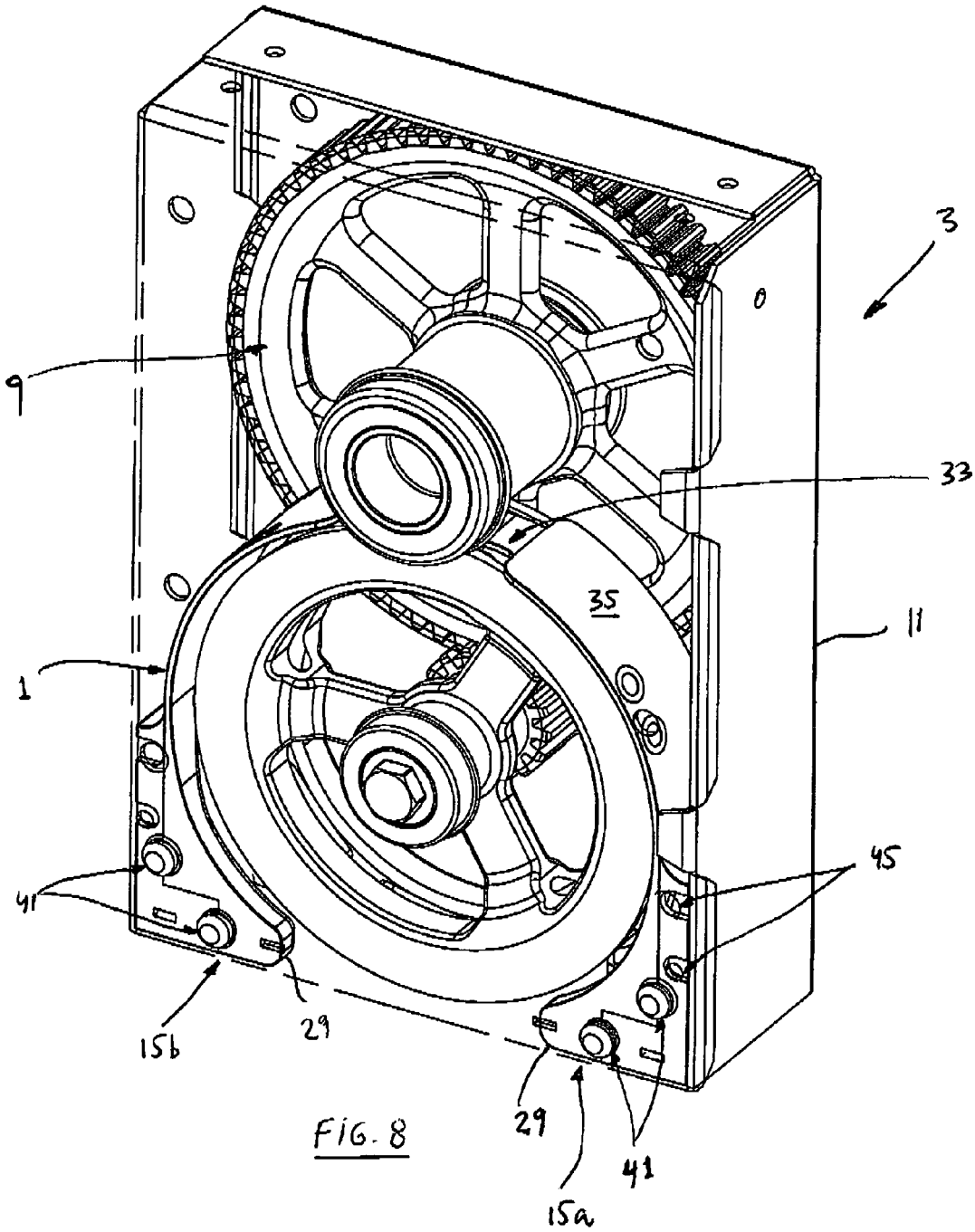
FIG. 8 is a perspective view of the chain hoist and chain guide shown in FIG. 4, the chain hoist being now shown deprived of its corresponding chain.
Figure 9:
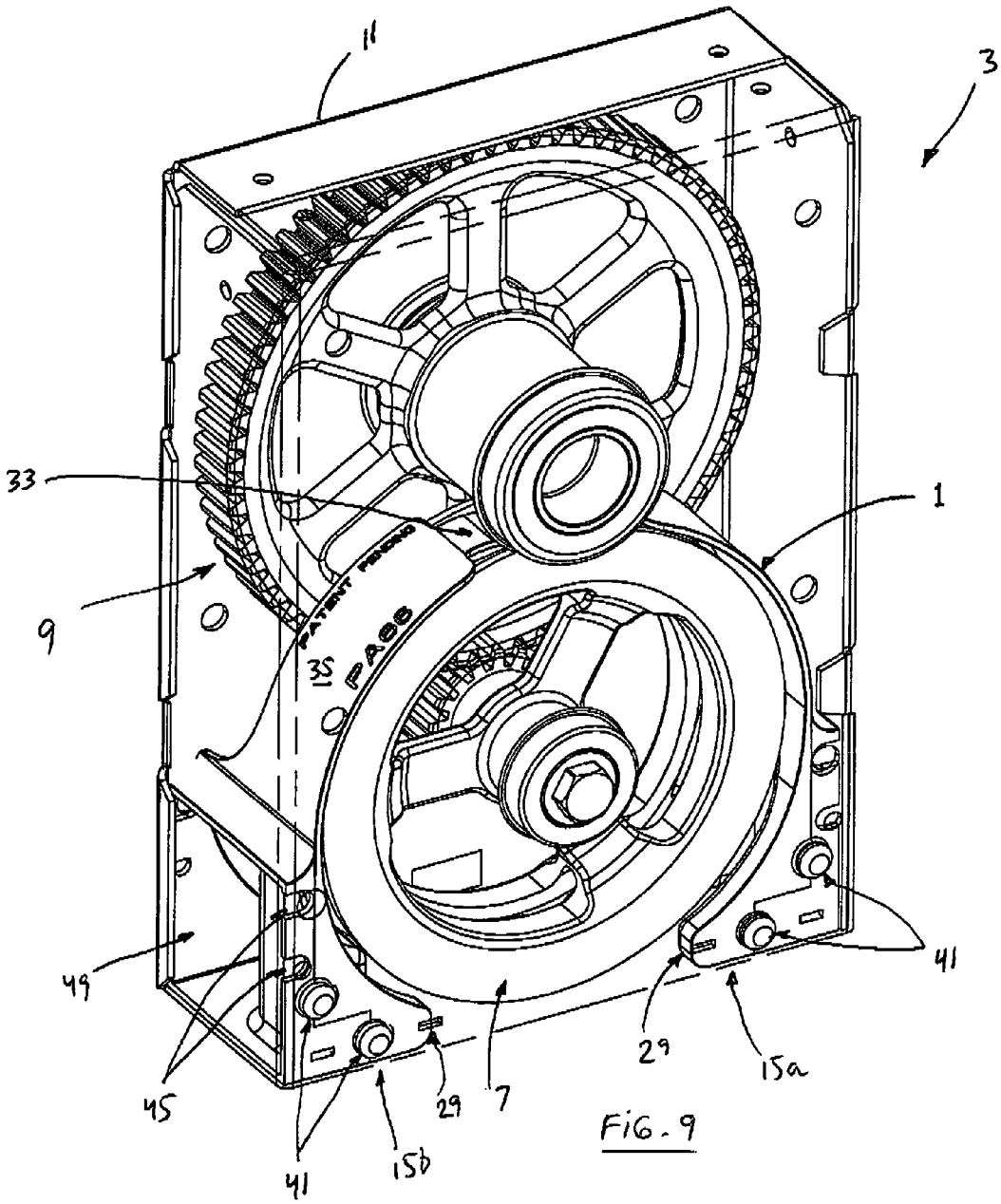
FIG. 9 is another perspective view of what is shown in FIG. 8.
Figure 10:
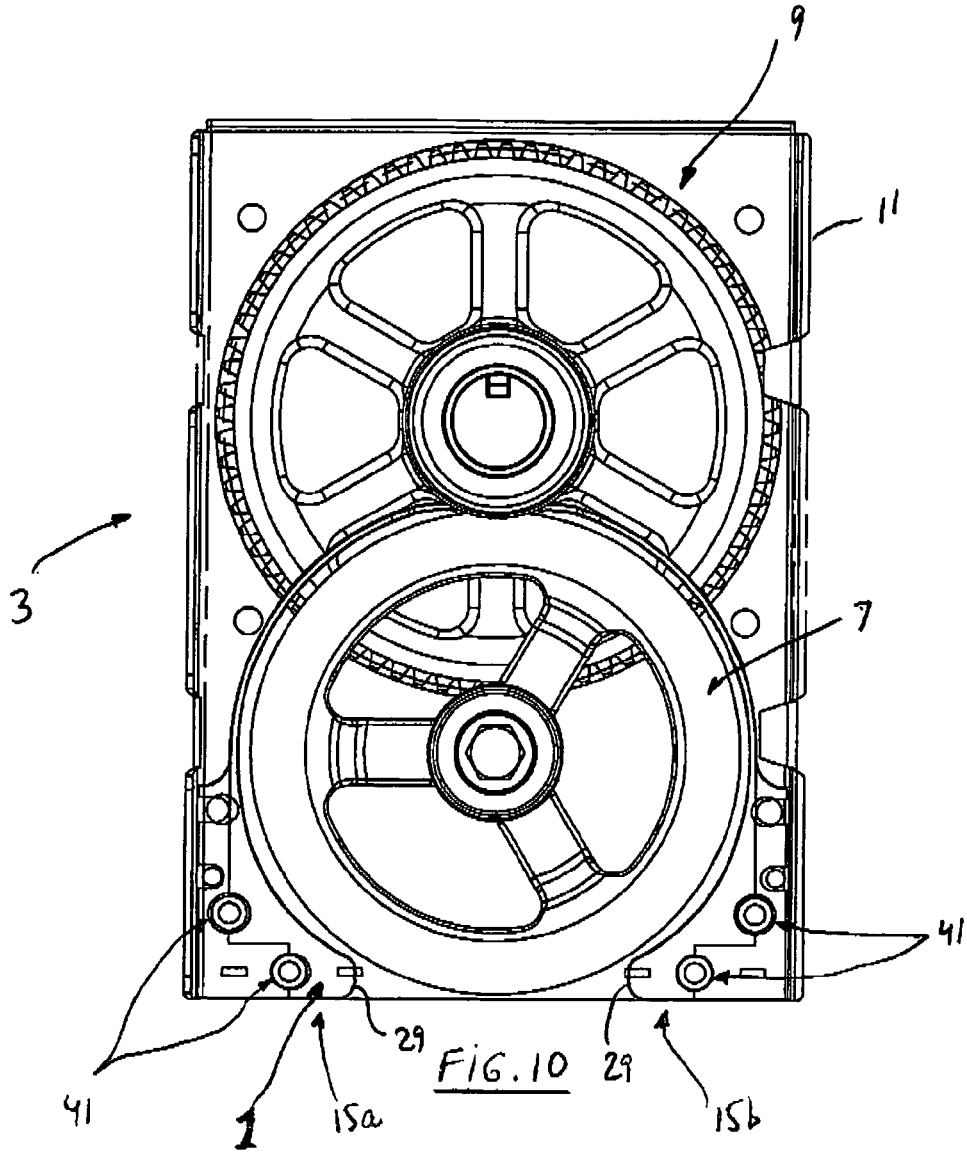
FIG. 10 is a front plan view of what is shown in FIG. 8.
Figure 11:
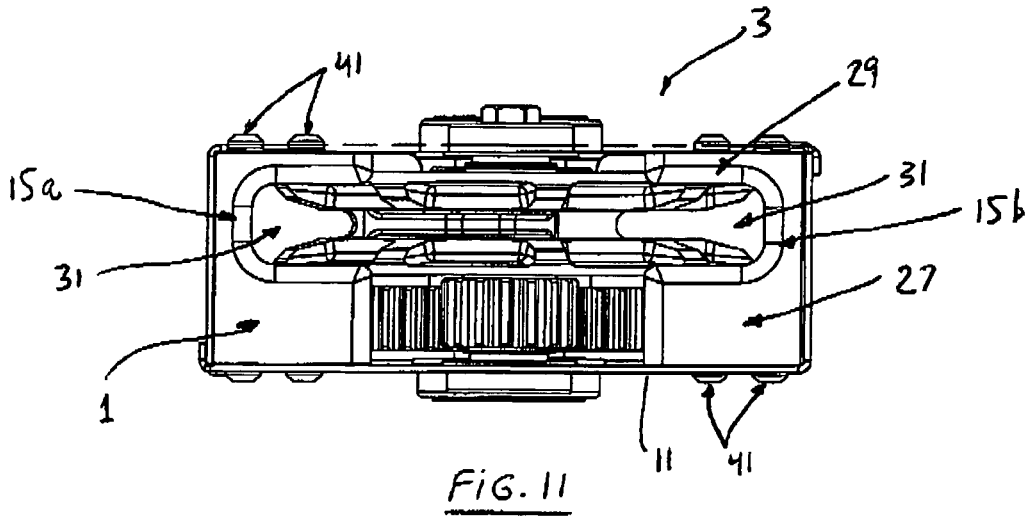
FIG. 11 is a bottom plan view of what is shown in FIG. 10.

For example, the system exemplified in FIG. 3 represents a simple chain hoist comprising a main gear (i.e. "first wheel" 9), a chain 5 and a chain pulley (i.e. "second wheel" 7). All these components are preferably operatively connected among each other via corresponding components (bearings, washers, gears, etc.) and enable to raise and lower a given door in a manner well known in the art. FIGS. 3 to 11 better exemplify the various internal components of the chain hoist according to a preferred embodiment of the present invention.

More particularly, the chain guide 1 according to the present invention is preferably operatively fixed to the casing 11 of the chain hoist and surrounds the chain pulley in the manner exemplified so as to be able to guide the latter during its entry and its exit from the chain hoist, as can be easily understood when referring to FIGS. 4 to 11.

Indeed, according to the present invention, the chain guide 1 is used for guiding the chain within the chain hoist, and comprises a substantially elongated body 13, first and second chain receiving portions 15*a,* 15*b,* and a connecting portion 17.

Figure 21:
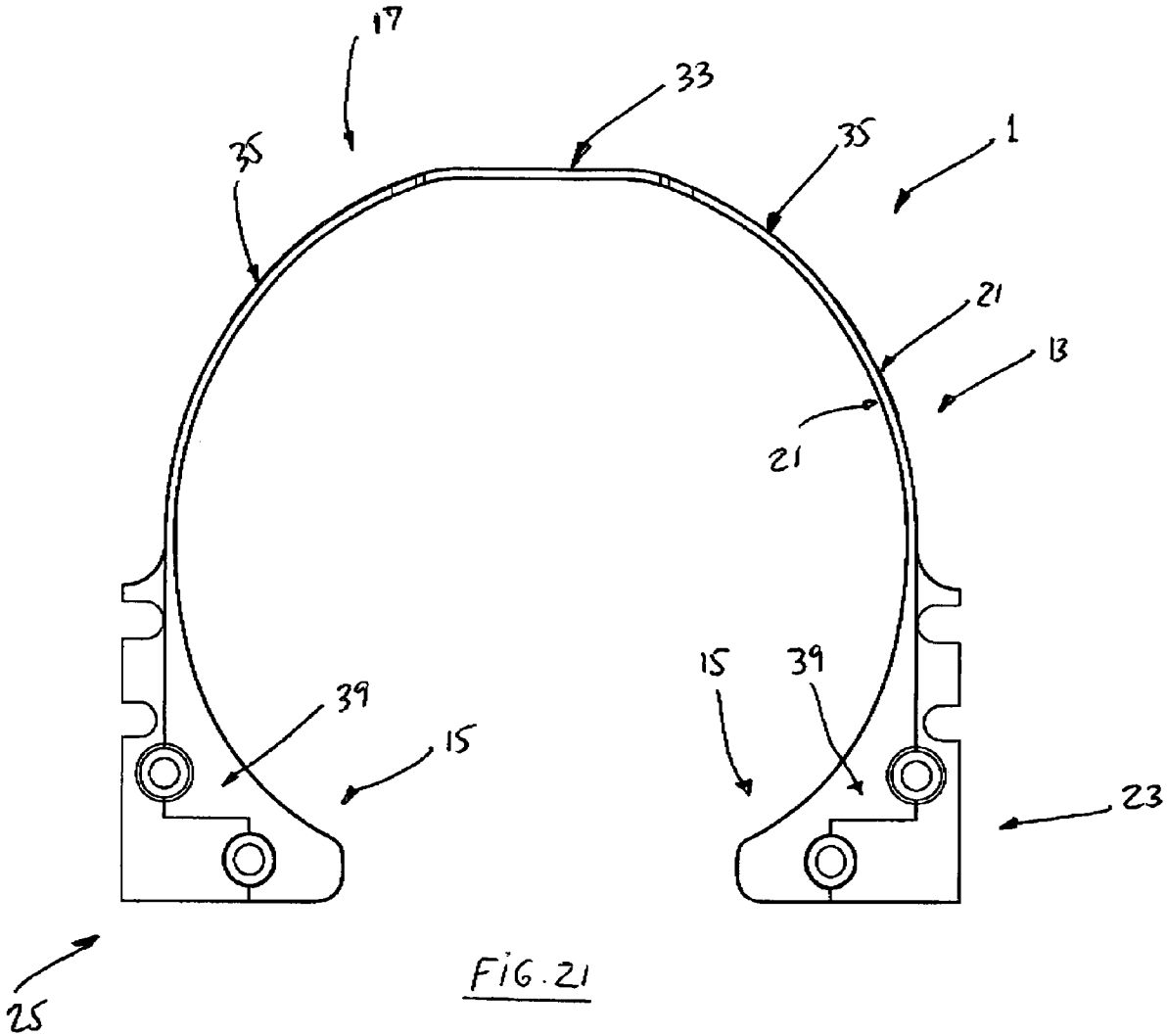
FIG. 21 is a rear plan view of what is shown in FIG. 16.

The substantially elongated body 13 has an inner side 19 and an outer side 21, along with first and second extremities 23,25. Preferably also, the substantially elongated body is made of a substantially flexible material for curving said substantially elongated body 13 into a substantially arched configuration, as better shown in FIGS. 12-16, and as can be easily understood when contrasting FIGS. 21 and 22.

The first and second chain receiving portions 15*a*,15*b* are provided adjacent to the first and second extremities 23,25 respectively of the substantially elongated body 13, on the inner side 19 thereof, each chain receiving portion 15 comprising a first and second shoulders 27,29 protruding from the inner side 19 of the body 13 and defining an open channel 31 shaped and sized for slidably receiving a portion of the chain 5.

The connecting portion 17 operatively interconnects the first and second chain receiving portions 15*a*,15*b,* and is preferably configured to be flexible (deformable, twistable, etc.), as will be explained in greater details hereinbelow.

Preferably, the connecting portion 17 is made integral to the substantially elongated body 13, and comprises a middle section 33 positioned between a pair of neighboring sections 35, the middle section 33 having a width smaller than that of the neighboring sections 35.

In addition to the fact that the substantially elongated body 13 is made of a substantially flexible material, the provision of a connecting portion 17 having a middle portion 33 with a width smaller than that of its corresponding neighboring sections 35 is particularly advantageous, in that, it enables the chain guide 1 to deform itself via a twisting or other suitable motion, namely in the connecting portion 17, so as to allow the passage of certain knots, which may be present in the chain 5 of the chain hoist, as can be easily understood by a person skilled in the art.

Figure 12:
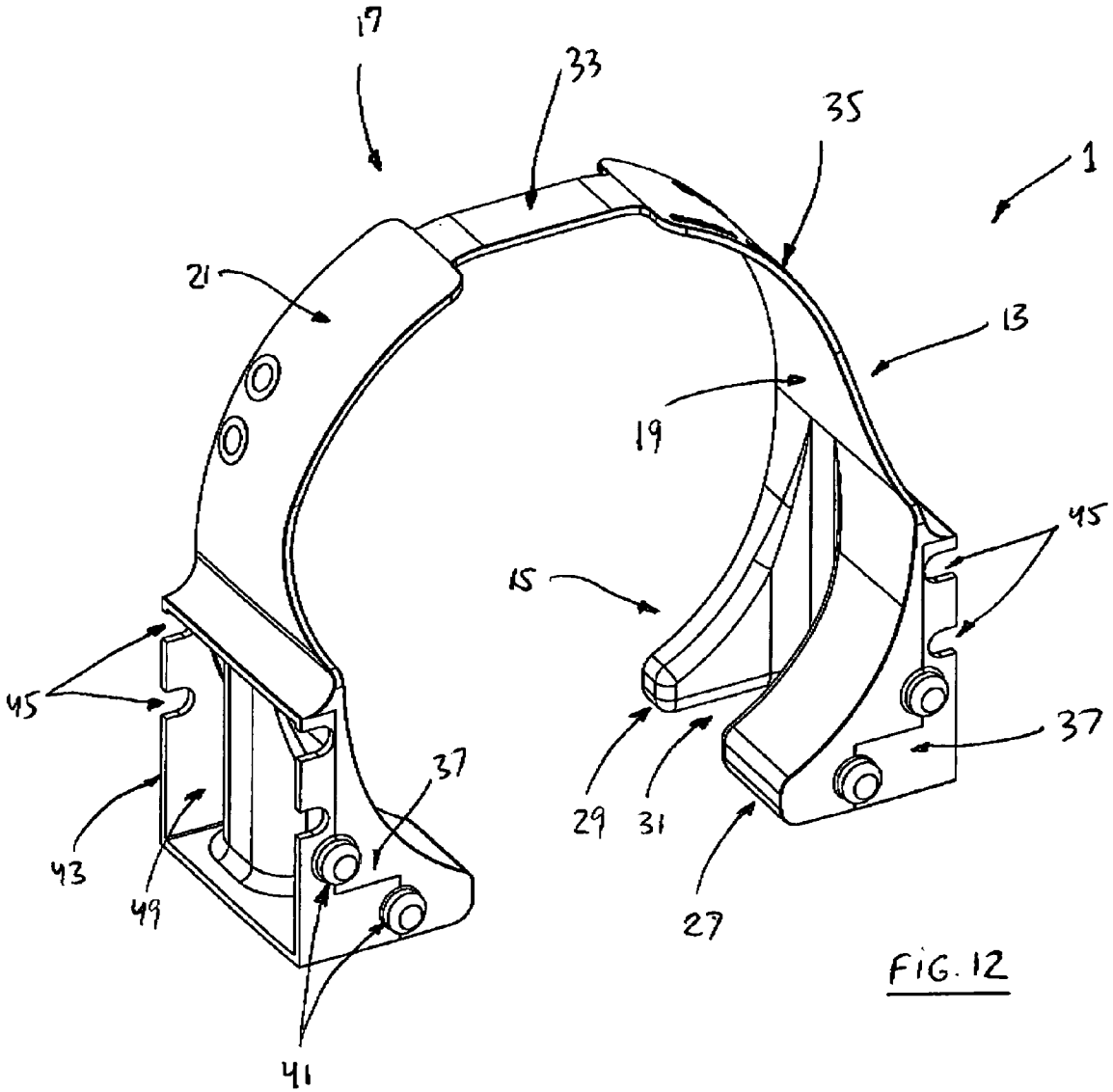
FIG. 12 is a perspective view of a chain guide according to a preferred embodiment of the present invention.
Figure 13:
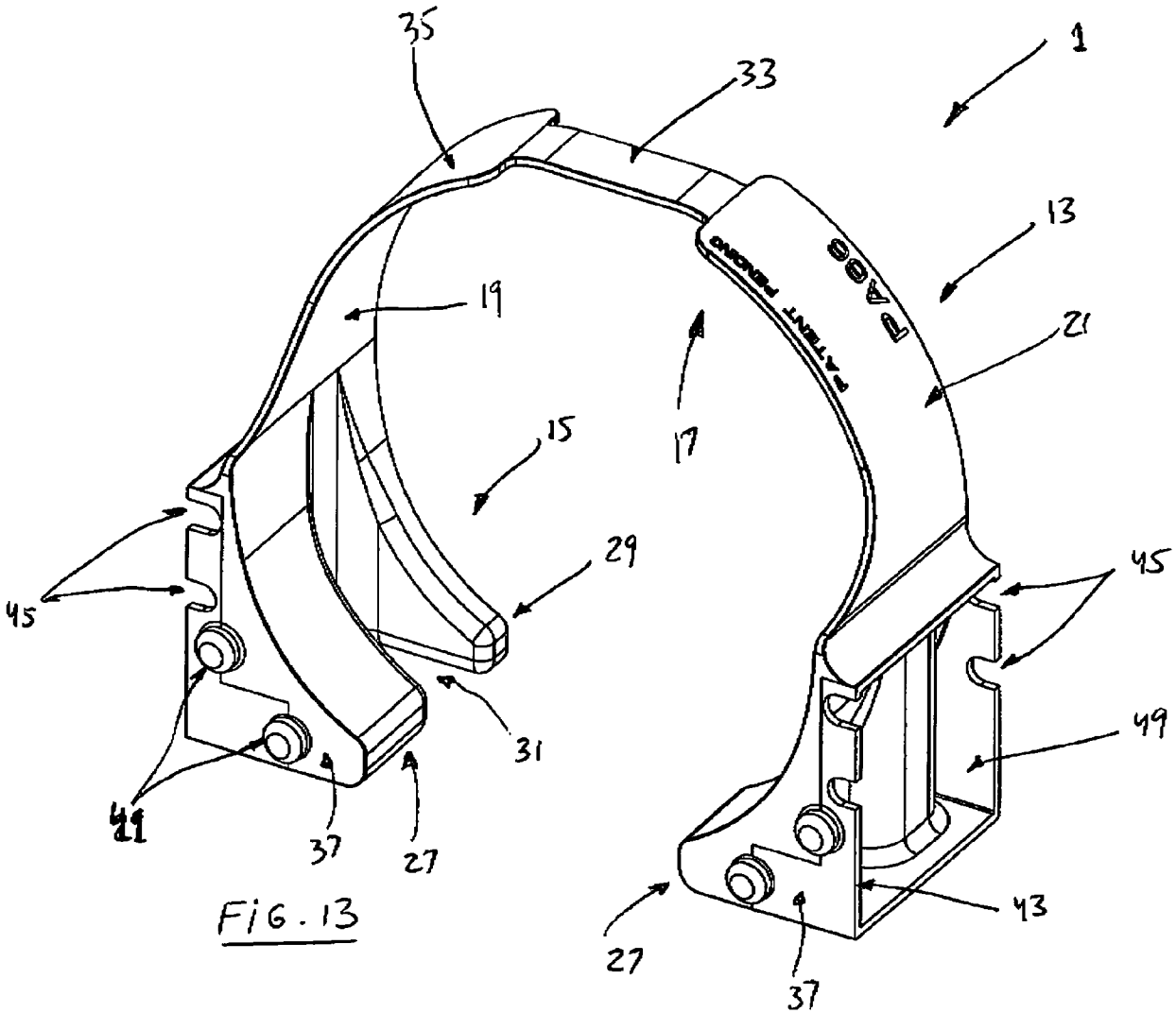
FIG. 13 is another perspective view of what is shown in FIG. 12.
Figure 14:
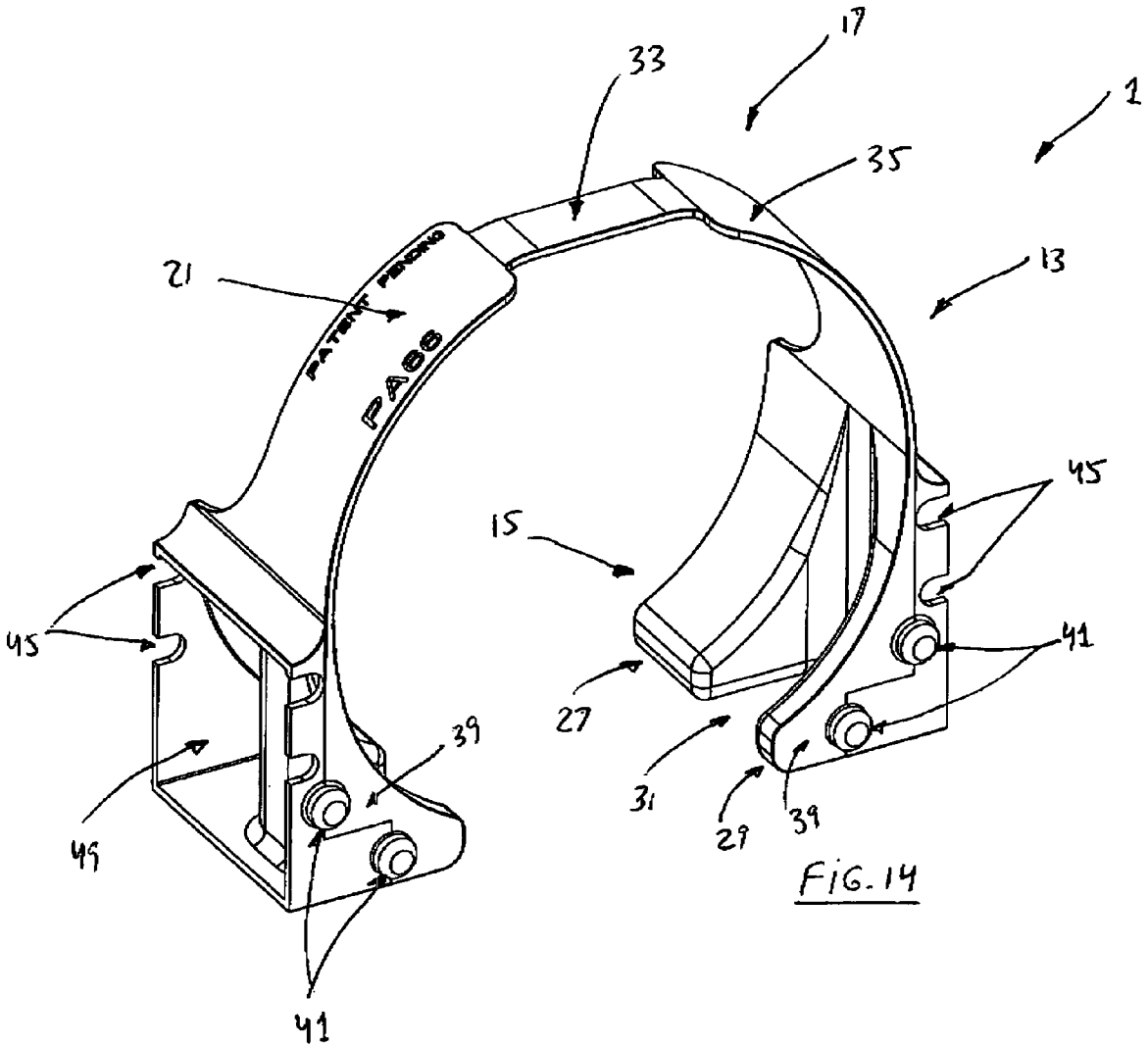
FIG. 14 is a rear perspective view of what is shown in FIG. 12.
Figure 15:
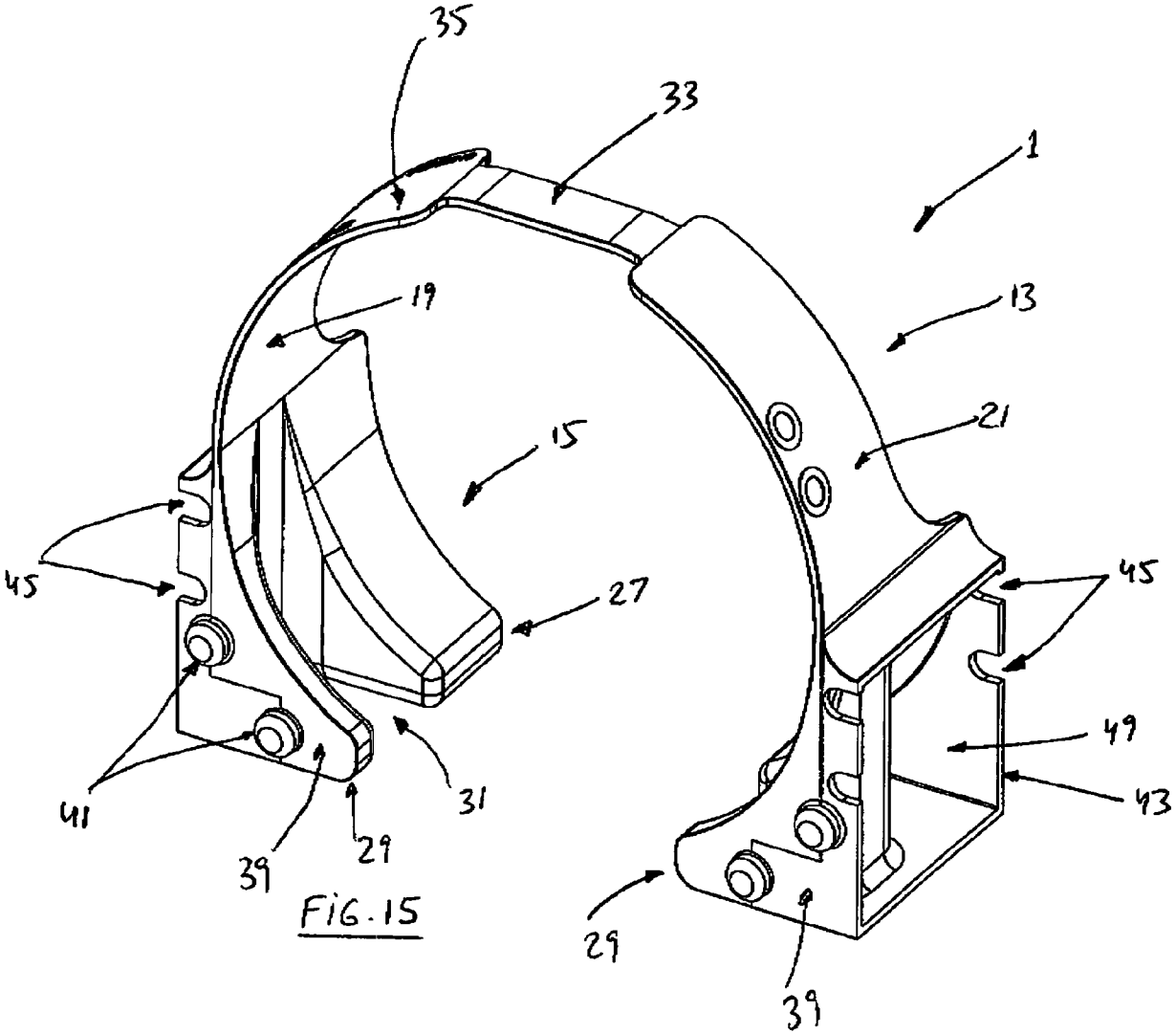
FIG. 15 is another rear perspective view of what is shown in FIG. 12.
Figure 16:
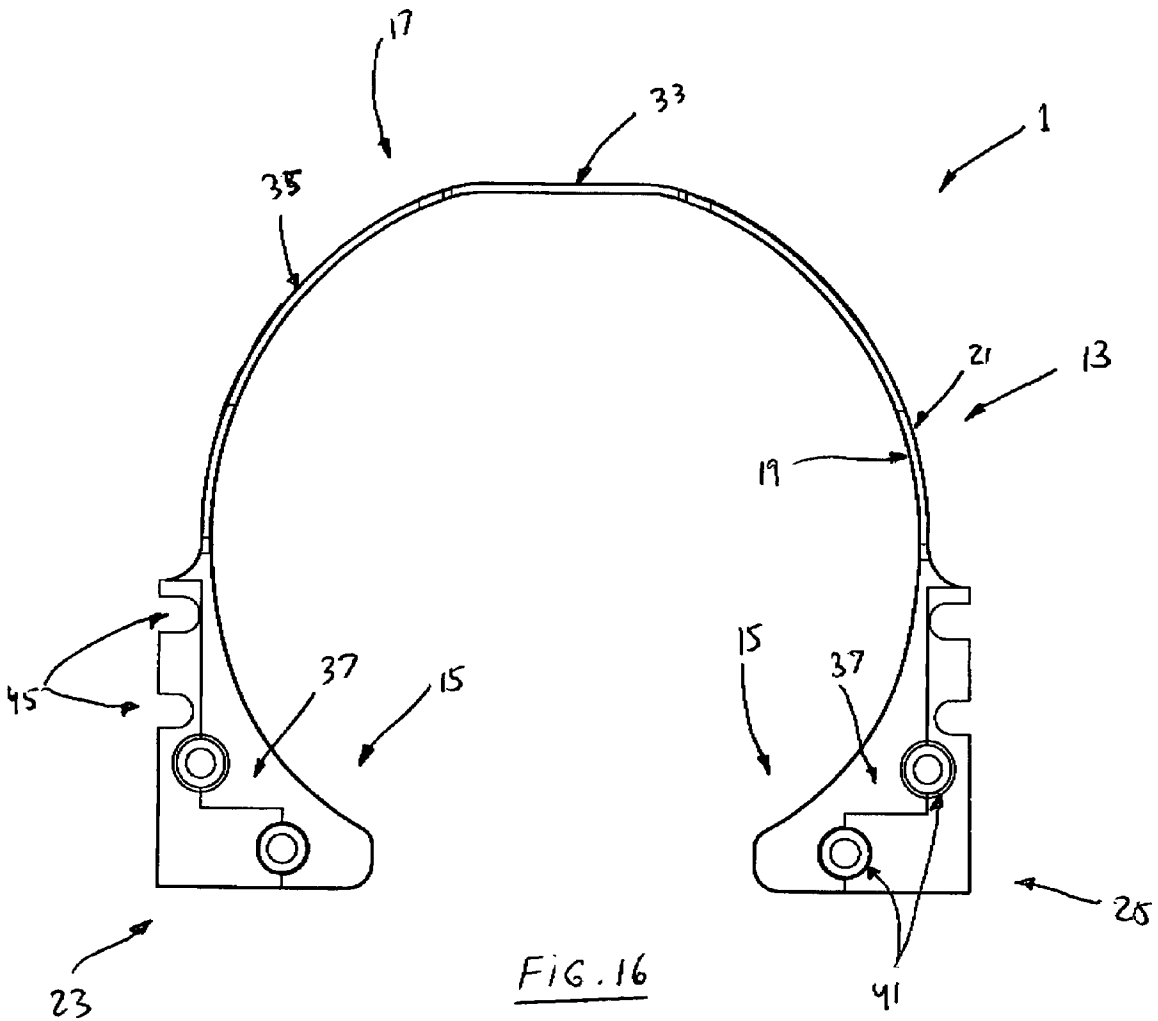
FIG. 16 is a front plan view of what is shown in FIG. 12.

Preferably also, each pair of shoulders comprises first and second shoulders 27,29, the first shoulder 27 of each chain receiving portion 15 being wider than the second shoulder 29 thereof, as better shown in FIG. 12 for example.

Referring now more particularly to FIGS. 12-17, each chain receiving portion 15 preferably comprises front and rear sides 37 and 39, each of which comprises at least one protruding insert 41 being removably insertable into at least one corresponding hole of the chain hoist for enabling to secure the chain guide 1 in place within the chain hoist, as can be easily understood when referring to FIGS. 1-6. Preferably, the front and rear sides 37,39 are provided on outer faces of the first and second shoulders 27,29 respectively of each chain receiving portion 15, and the at least one protruding insert 41 comprises a pair of protruding inserts 41 being removably insertable into a corresponding pair of holes of the chain hoist, as also better shown in FIGS. 12-17.

Preferably, the front and rear sides 37,39 of each chain receiving portion 15 may comprise a rear edge 43 extending along the outer side of the substantially elongated body 13 and being provided with at least one hook 45 for removably hooking onto at least one corresponding support member of the chain hoist so as to enable to secure the chain guide 1 in place within the chain hoist, as better shown in FIGS. 12-17. Preferably also, the at least one hook 45 comprises a pair of hooks 45 for removably hooking onto a corresponding pair of support members of the chain hoist, as can be easily understood when referring to FIGS. 4-10.

The above-mentioned components and features, enable namely the chain guide 1 to easily and security mount itself within the chain hoist, either via its corresponding protruding inserts 41, its corresponding hooks 45, or by virtue of the width of the shoulders 27,29, which are preferably intended to occupy and fill out the width of the inner casing 11, as better shown in FIGS. 4-11, so as to enable the chain guide 1 according to the present invention to not only guide the chain 5 within the chain hoist, but also act as a damping device, in terms of vibrations, noise and the like, as can be easily understood by a person skilled in the art.

Figure 17:
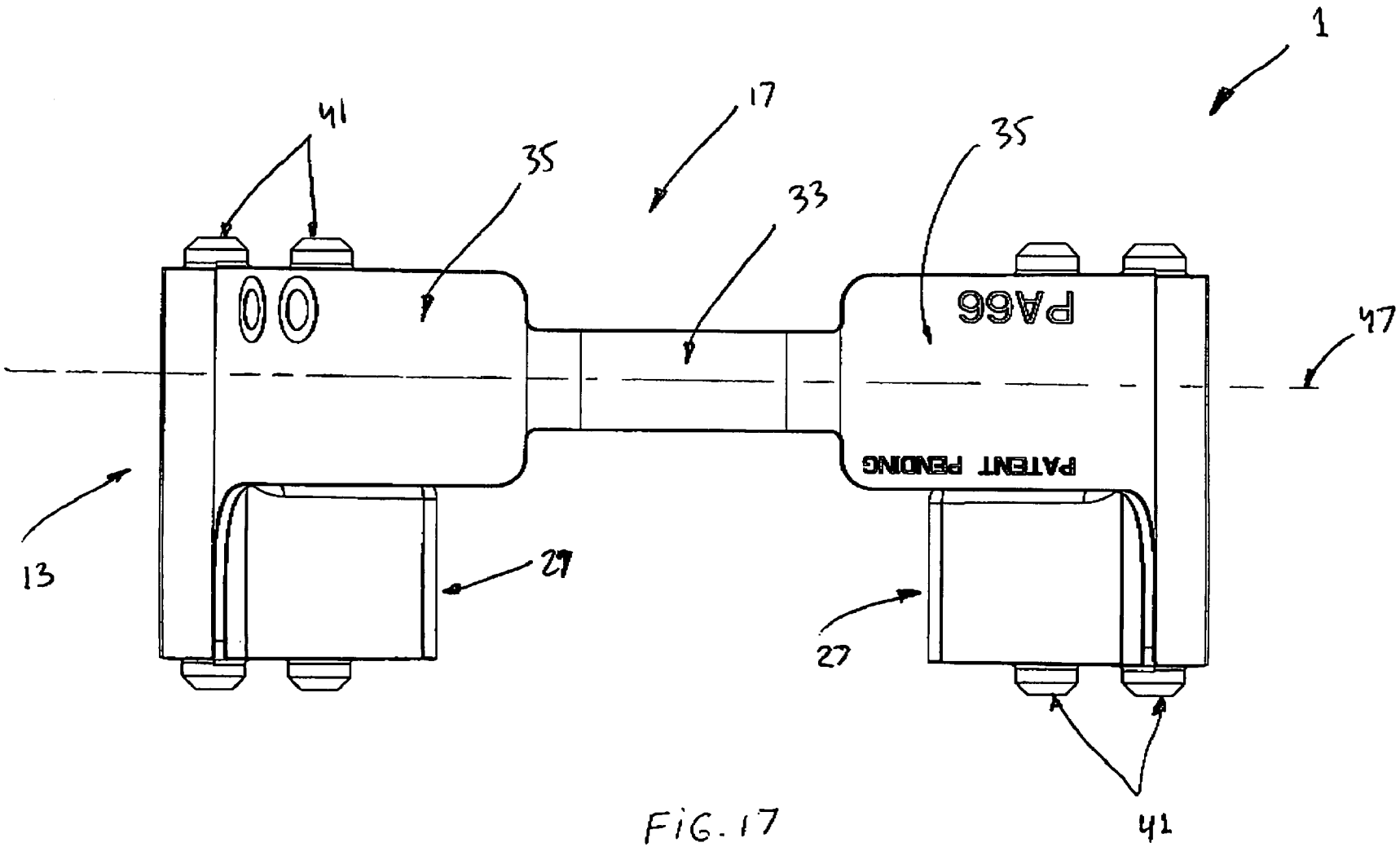
FIG. 17 is a top plan view of what is shown in FIG. 16.
Figure 18:
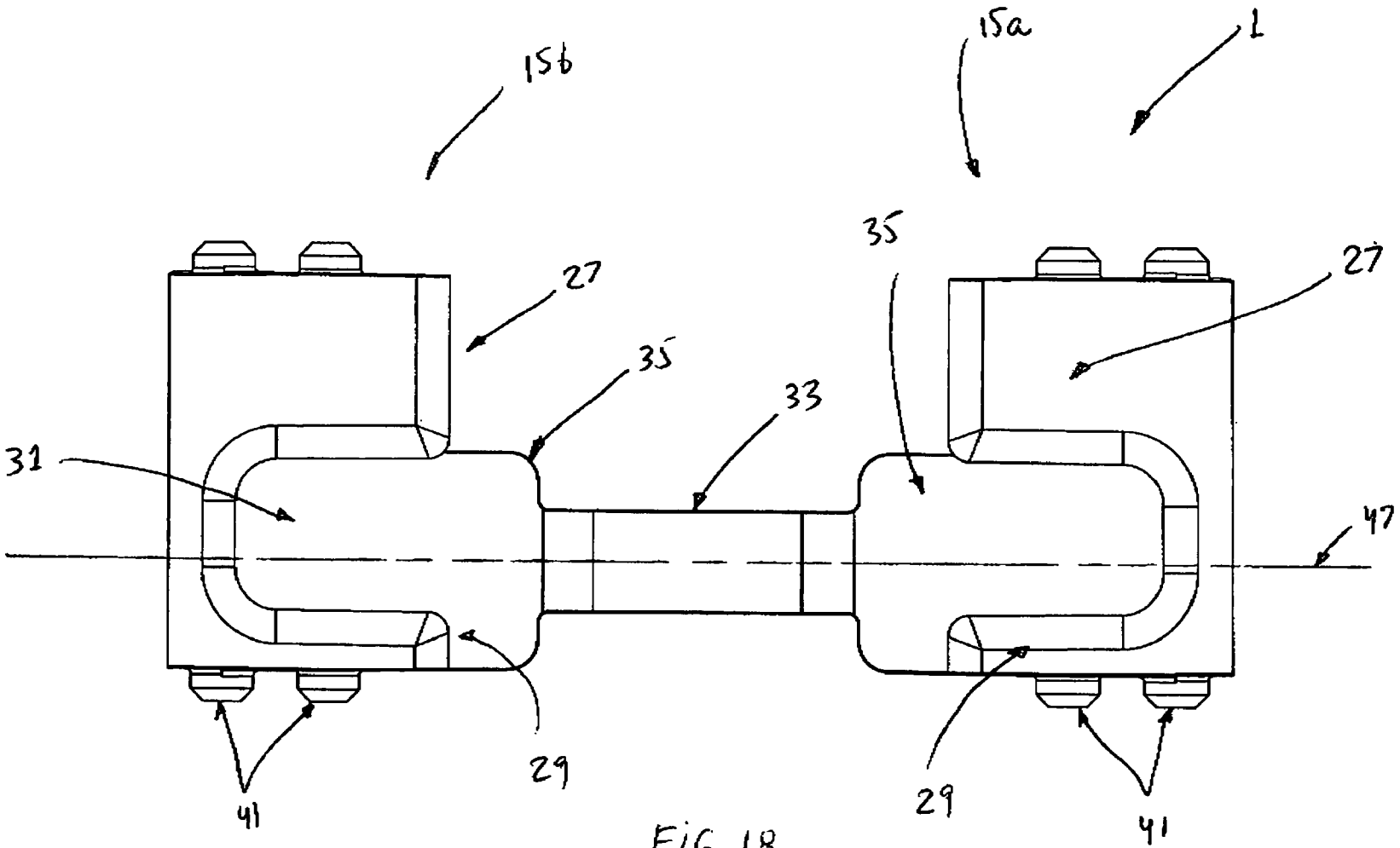
FIG. 18 is a bottom plan view of what is shown in FIG. 16.
Figure 19:
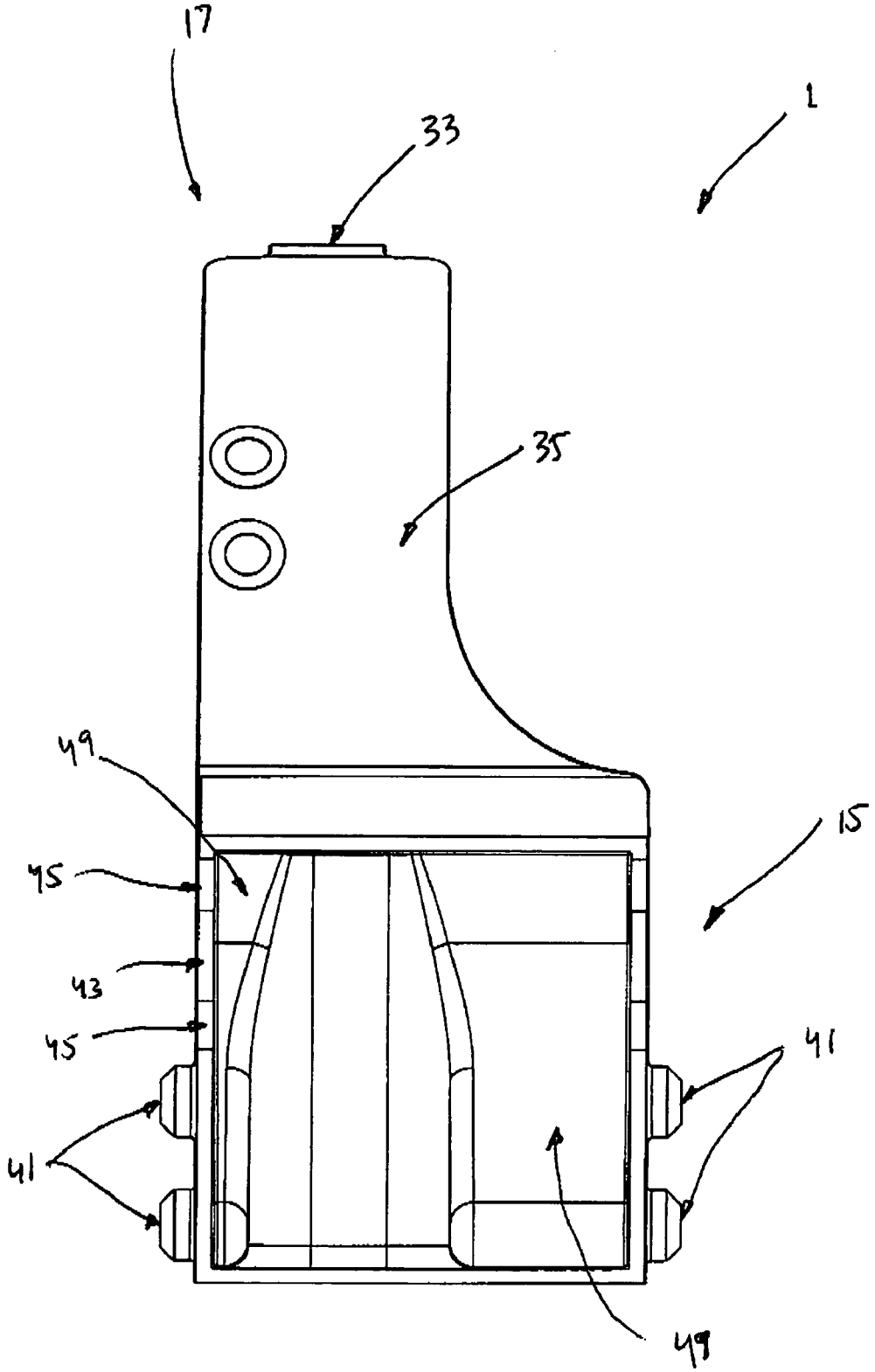
FIG. 19 is a left side elevational view of what is shown in FIG. 16.
Figure 20:
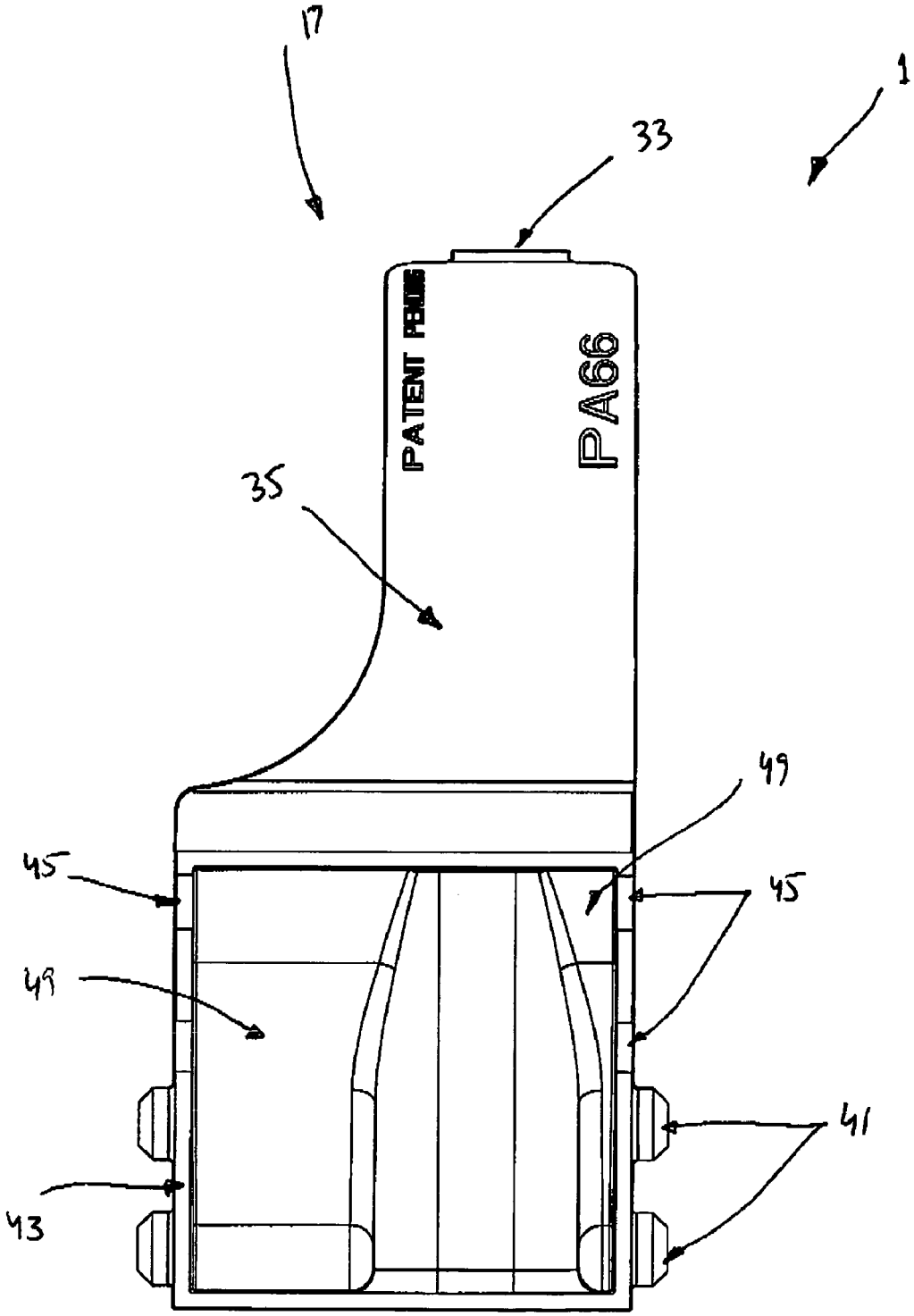
FIG. 20 is a right side elevational view of what is shown in FIG. 16.

Preferably, and as better shown in FIGS. 17-18, the substantially elongated body 13 comprises a longitudinal axis 47, and the middle section 33 of the connecting portion 17 and the open channels 31 of the chain receiving portions 15 are longitudinally aligned with respect to said longitudinal axis 47 of the substantially elongated body 13.

Although these particular components and features are not absolutely essential to the present invention, as can be easily understood by a person skilled in the art, they are nevertheless advantageous in that, by aligning the middle section 33 of the connecting portion 17 and the open channels 31 of the chain receiving portions 15 longitudinally with respect to each other, and with respect to the longitudinal axis 47 of the substantially elongated body 13, which is preferably in turn aligned with the receiving groove of the corresponding wheel 7 ("chain pulley") receiving the corresponding chain 5 of the chain hoist, the chain guide 1 is thus enable to better guide the chain 5 within the chain hoist, as can also be easily understood by a person skilled in the art.

Preferably, the first and second shoulders 27,29 of each chain receiving portion 15 extend on either side of the longitudinal axis 47 of the substantially elongated body 13 so as to each have an offset with respect to said longitudinal axis 47, and wherein the offset of the first shoulder 27 is greater than the offset of the second shoulder 29, as better shown in FIG. 18.

Preferably also, the shoulders 27,29 of the chain receiving portions 15 are arched so that the inner side 19 of the substantially elongated body 13 forms a substantially circular profile when curved into the substantially arched configuration, as better shown in FIGS. 12-21.

Figure 22:
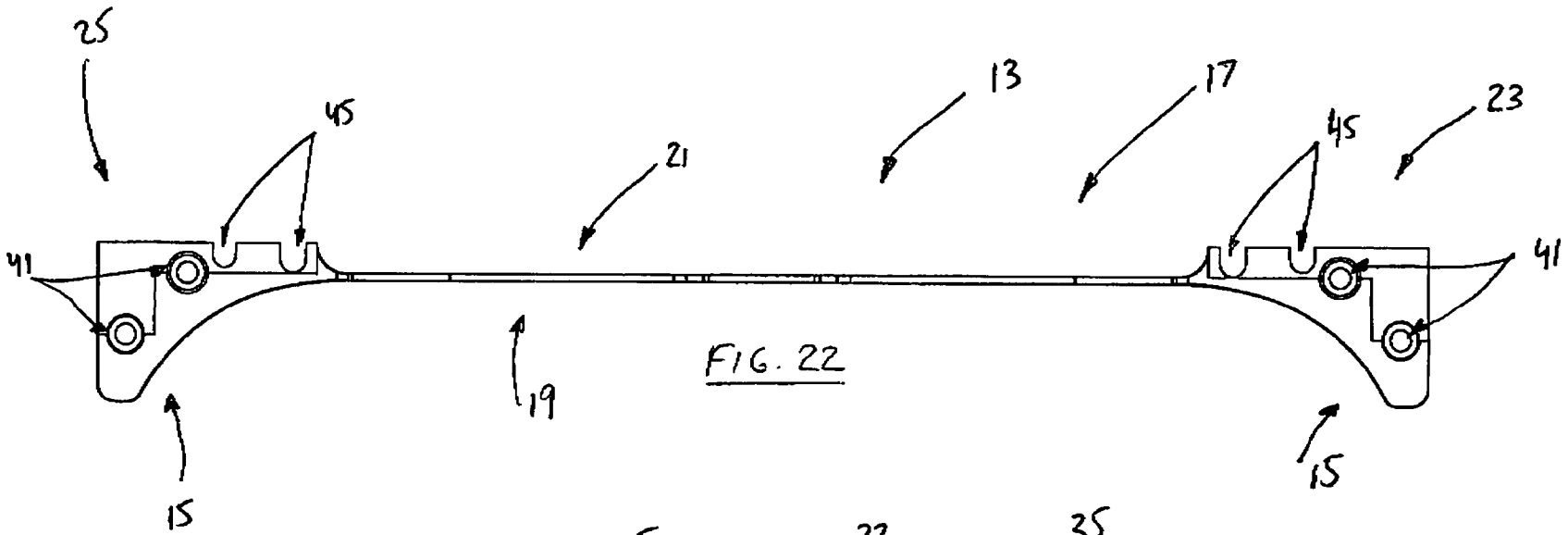
FIG. 22 is another front view of what is shown in FIG. 21, the chain guide being now shown in an extended configuration.
Figure 23:
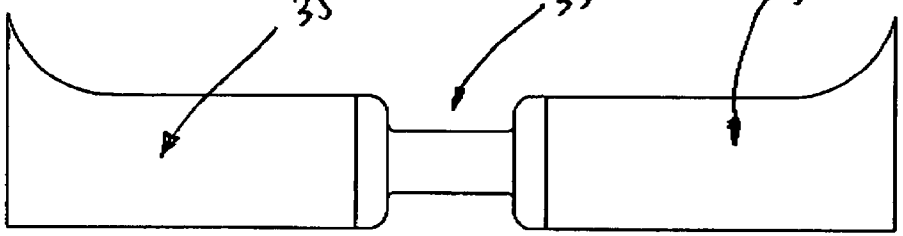
FIG. 23 is a top plan view of the connecting portion of the chain guide shown in FIG. 22.

As better shown in FIGS. 12-15, the shoulders 27,29 protruding from the inner side of the substantially elongated body 13 preferably define complementary recesses 49 on a corresponding section of the outer side 21 of said substantially elongated body 13, adjacent to the extremities 23,25 thereof, as can be easily understood when referring to FIG. 22.

Preferably also, the substantially elongated body 13, chain receiving portions 15 and connecting portion 17 of the chain guide 1 consist of a single component made of a single material. Preferably also, the material is nylon PA66 with cold impact additive, and the chain guide 1 is made by injection molding.

The choice of material being used, and the particular design and profile of the chain guide 1, namely recesses 49 being defined on the outer side 21 of the substantially elongated body 13, adjacent to the extremities 23,25 thereof and behind the shoulders 27,29 protruding from the inner side 19, enable for the chain guide 1 to properly carry out its corresponding functions, namely the guiding of the chain within the chain hoist, in addition to providing substantial advantages, namely in terms of noise/vibration damping, and the like, but also without adding substantial weight to the chain hoist. Furthermore, the chain guide 1 is preferably manufactured in a cost-effective manner, using a suitable material, such as the aforementioned and via a suitable manufacturing process, such as injection molding and the like, although other suitable materials and manufacturing processes can be used for manufacturing a chain guide 1 similar to the one described herein and exemplified in the accompanying drawings, as can be easily understood by a person skilled in the art.

According to the present invention, the chain pulley preferably comprises pockets in which are interposed the links of the chain 5. Thus, as may now be better understood by a person skilled in the art, the chain guide 1, by virtue of its components and designs, as exemplified in the accompanying drawings, and more particularly on FIGS. 12-22, aids in securing the links of the operating chain within the aforementioned pockets, as better illustrated in FIGS. 3-11. During an excessive rotation of the main shaft of the door, the flexible band (i.e. connecting portion 17) of the chain guide 1 may deform itself on one side or the other, depending on where is applied the pressure caused by the chain 5 which wants to come out from the pockets of the chain pulley (it is important to note that typically, in conventional systems, nothing retains the chain 5 within the pulley).

Figure 25:
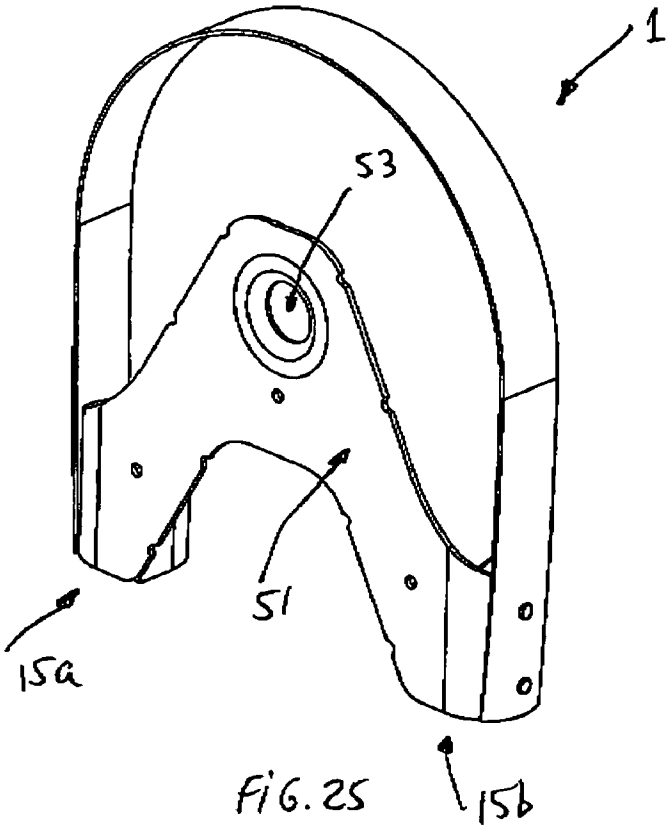
FIG. 25 is a rear perspective view of what is shown in FIG. 24.
Figure 24:
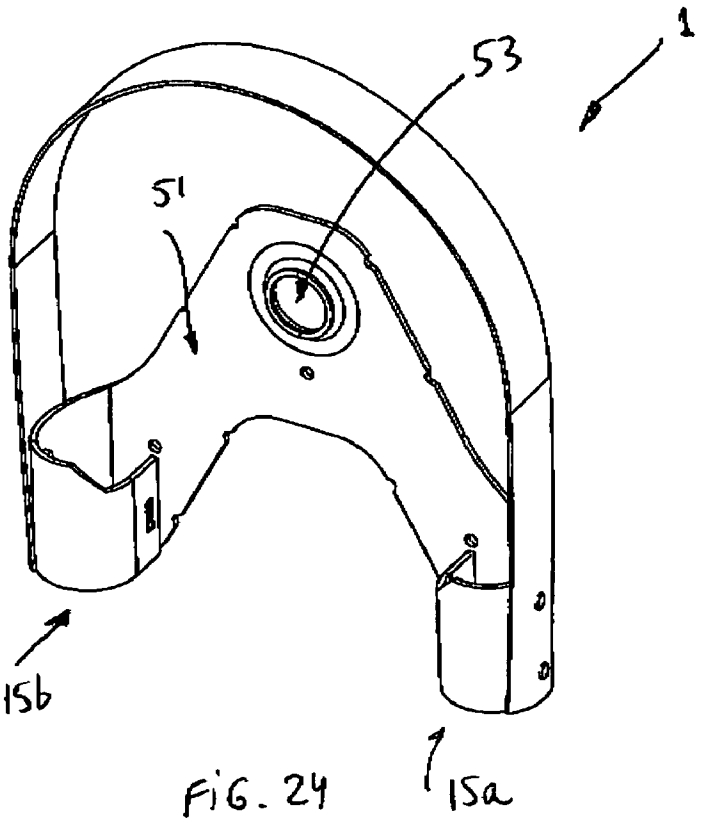
FIG. 24 is a perspective view of a chain guide according to yet another preferred embodiment of the present invention, the chain guide being provided with a support portion.
Figure 27:
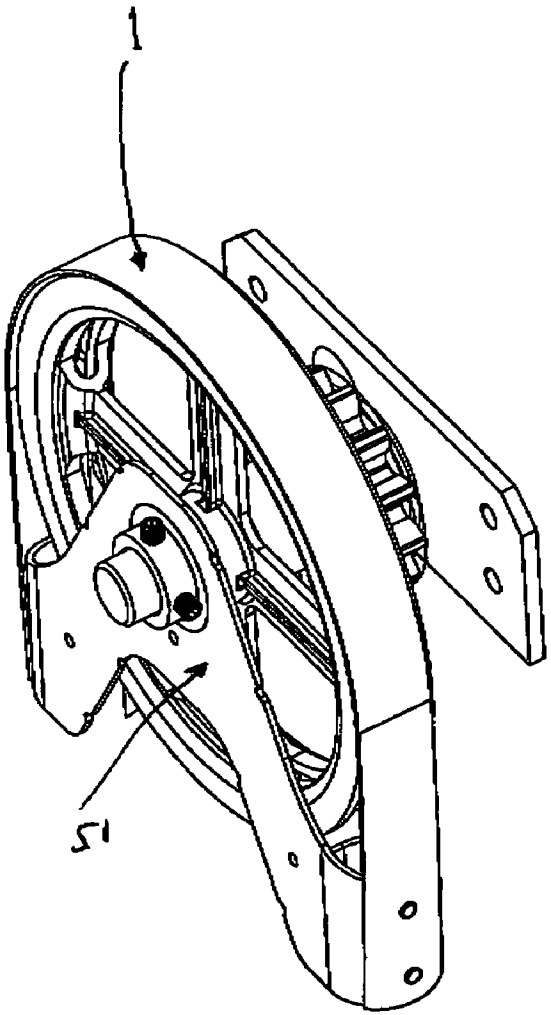
FIG. 27 is another perspective view of what is shown in FIG. 26.
Figure 26:
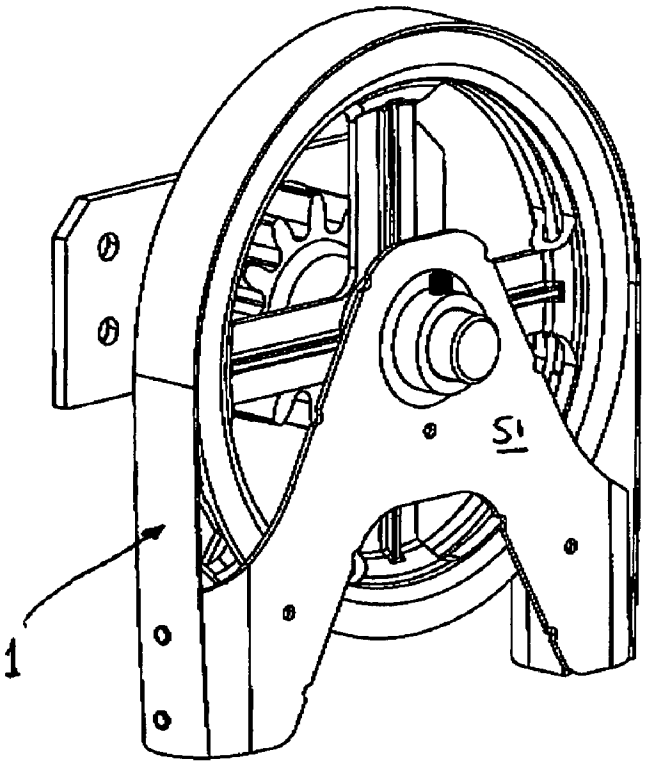
FIG. 26 is a perspective view of a chain hoist provided with the chain guide of FIG. 25.

Several modifications and/or additions could made to the chain guide 1 without departing from the scope of the present invention, depending on the particular applications for which it is intended for and the corresponding chain hoist with which it is meant to be used, as can be easily understood by a person skilled in the art. Indeed, for example, the chain guide 1 may comprise a support portion 51 extending between corresponding shoulders of the first and second chain receiving portions 15*a*, 15*b*, as better shown in FIGS. 24-25. This support portion 51 could also comprise an orifice 53 for removably hooking the chain guide 1 via its support portion 51 onto a component of the chain hoist, particularly in the case of an "open" chain hoist (i.e. without a casing 11), as better shown in FIGS. 26-27.

It is important to mention that several other modifications could be made to the chain guide 1 and/or drive mechanism 5 including the same, depending on the particular application for which it is intended, as apparent to a person skilled in the art, without departing from the scope of the present invention. For example, the chain guide could be installed on various types of systems using a chain pulley. Indeed, the steel guiding plates of a conventional chain hoist could be replaced and provided with a corresponding chain guide 1 according to the present invention, as described herein, and exemplified in the accompanying drawings, so as to convert said chain hoist into a chain hoist according to the present invention, with resulting advantages, as further explained hereinbelow. Furthermore, it is possible according to the present invention to install chain guides 1 according to the present invention on both closed chain hoists, as well as opened chain hoists which do not comprise any structure enabling to hide its internal components. Furthermore, the affixing of the chain guide 1 onto the chain hoist can be carried out in various manners, depending on the particular type of chain hoist being used, as also apparent to a person skilled in the art. Furthermore, the material used for the chain guide 1, drive mechanism 5 including the same and/or the different components thereof, as well as the design of these various components, can change greatly so long as the connecting portion 17 of the chain guide 1 that covers the chain hoist, as exemplified in the accompanying drawings, remains relatively flexible (deformable, twistable, etc.) in order to carry out the above described functions and resulting advantages.

Moreover, according to the present invention, the chain hoist and corresponding parts are preferably made of substantially rigid materials, such as metallic materials (steel, etc.), hardened polymers, composite materials, and/or the like, whereas the chain guide 1 itself according to the present invention, in order to achieve the resulting advantages briefly discussed herein, is preferably made of a suitably malleable and resilient material, such as a polymeric material (plastic, etc.), and/or the like, depending on the particular applications for which the chain guide 1 and corresponding chain hoist are intended for and the different parameters in cause (counterbalancing force in the spring, weight of the door, type of chain being used, etc.), as apparent to a person skilled in the art.

As being now better appreciated, the present invention is an improvement and presents several advantages over other related devices and/or methods known in the prior art. Indeed the present invention may be used in the garage door industry, with new chain hoists or existing chain hoists. Furthermore, as explained hereinabove, the chain guide 1 according to the present invention comprises a flexible band (i.e. connecting portion 17) which preferably surrounds the chain pulley and is preferably devised so as to be able to deform itself and allow the passage of certain knots or twists which may form themselves in the links of the corresponding chain 5. Preferably also, for certain knots of greater dimensions which cannot physically pass in the chain hoist, the chain guide 1 thereof is preferably designed so as to resist corresponding impacts, and if need may be, deform itself accordingly, until the necessary inspections and/or repairs are made.

The present invention is also particularly advantageous in that the design of a chain guide 1 as exemplified in the accompanying drawings is preferably intended to continuously maintain the chain 5 inside the pulley and also to decrease any resulting noise which could be produced by the chain hoist when the garage door is raised or lowered rapidly. Indeed, as previously explained, the faster a given chain turns about a chain pulley, the greater the risk of provoking resulting vibrations in the corresponding internal components of the chain hoist. Furthermore, noise is very often amplified by the resonance of the casing (typically, a metallic casing) created often by a closed chain hoist. Thus, as may now better be appreciated, the use of a flexible chain guide 1 (with corresponding components (insert 41, hooks 45, shoulders 27,29, etc.)) according to the present invention, which is preferably made of a suitable polymeric material and the like, such as plastic for example, enables to limit the transmission of such vibrations through the mobile components of the chain hoist, and thus enables for a more silent chain hoist.

Of course, numerous modifications could be made to the above-described embodiments without departing from the scope of the invention, as defined in the appended claims.

The invention claimed is:

1. A chain guide for guiding a chain about a pocket wheel within a chain hoist, the chain guide comprising:

a substantially elongated body having an inner side and an outer side, along with first and second extremities, the substantially elongated body being made of a substantially flexible material for curving said substantially elongated body into a substantially arched configuration about the pocket wheel;

first and second chain receiving portions provided adjacent to the first and second extremities respectively of the substantially elongated body, on the inner side thereof, each chain receiving portion comprising a first and second shoulders protruding from the inner side of the body and defining an open channel shaped and sized for slidably receiving a portion of the chain; and a connecting portion for operatively interconnecting the first and second chain receiving portions, the connecting portion including a flexible band capable of deforming to allow a passage of a knot or a twist formed along a segment of the chain when passing between the pocket wheel and the connecting portion of the chain guide.

2. A chain guide according to claim 1, wherein the connecting portion is made integral to the substantially elongated body, and comprises a middle section positioned between a pair of neighboring sections, the middle section having a width smaller than that of the neighboring sections.

3. A chain guide according to claim 1, wherein each pair of shoulders comprises first and second shoulders, the first shoulder of each chain receiving portion being wider than the second shoulder thereof.

4. A chain guide according to claim 1, wherein each chain receiving portion comprises front and rear sides, each of which comprises at least one protruding insert being removably insertable into at least one corresponding hole of the chain hoist for enabling to secure the chain guide in place within the chain hoist.

5. A chain guide according to claim 4, wherein the front and rear sides are provided on outer faces of the first and second shoulders respectively of each chain receiving portion, and wherein the at least one protruding insert comprises a pair of protruding inserts being removably insertable into a corresponding pair of holes of the chain hoist.

6. A chain guide according to claim 1, wherein each chain receiving portion comprises front and rear sides, each of which comprises a rear edge extending along the outer side of the substantially elongated body and being provided with at least one hook for removably hooking onto at least one corresponding support member of the chain hoist so as to enable to secure the chain guide in place within the chain hoist.

7. A chain guide according to claim 6, wherein the front and rear sides are provided on outer faces of the first and second shoulders respectively of each chain receiving portion, and wherein the at least one hook comprises a pair of hooks for removably hooking onto a corresponding pair of support members of the chain hoist.

8. A chain guide according to claim 1, wherein the substantially elongated body comprises a longitudinal axis, and wherein the middle section of the connecting portion and the open channels of the chain receiving portions are longitudinally aligned with respect to said longitudinal axis of the substantially elongated body.

9. A chain guide according to claim 8, wherein the first and second shoulders of each chain receiving portion extend on either side of the longitudinal axis of the substantially elongated body so as to each have an offset with respect to said longitudinal axis, and wherein the offset of the first shoulder is greater than the offset of the second shoulder.

10. A chain guide according to claim 1, wherein the shoulders of the chain receiving portions are arched so that the inner side of the substantially elongated body forms a substantially circular profile when curved into the substantially arched configuration.

11. A chain guide according to claim 1, wherein the shoulders protruding from the inner side of the substantially elongated body define complementary recesses on a corresponding section of the outer side of said substantially elongated body, adjacent to the extremities thereof.

12. A chain guide according to claim 1, wherein the substantially elongated body, chain receiving portions and connecting portion of the chain guide consist of a single component made of a single material.

13. A chain guide according to claim 12, wherein the material is nylon PA66 with cold impact additive, and wherein the chain guide is made by injection molding.

14. A chain guide according to claim 1, wherein the chain guide comprises a support portion extending between corresponding shoulders of the first and second chain receiving portions.

15. A chain guide according to claim 14, wherein the support portion comprises an orifice for removably hooking the chain guide via its support portion onto a component of the chain hoist.

16. A chain guide for guiding a chain within a chain hoist, the chain guide comprising:

a substantially elongated body having an inner side and an outer side, along with first and second extremities, the substantially elongated body being made of a substantially flexible material for curving said substantially elongated body into a substantially arched configuration within the chain hoist and about a given wheel of said chain hoist receiving the chain;

first and second chain receiving portions provided adjacent to the first and second extremities respectively of the substantially elongated body, on the inner side thereof, each chain receiving portion comprising a pair of shoulders protruding from the inner side of the body and defining an open channel shaped and sized for slidably receiving a portion of the chain; and a connecting portion for operatively interconnecting the first and second chain receiving portions;

wherein the connecting portion is made integral to the substantially elongated body, and comprises a middle section positioned between a pair of neighboring sections, the middle section having a width smaller than that of the neighboring sections;

wherein each pair of shoulders comprises first and second shoulders, the first shoulder of each chain receiving portion being wider than the second shoulder thereof;

wherein each chain receiving portion comprises front and rear sides, the front and rear sides being provided on outer faces of the first and second shoulders respectively of each chain receiving portion, each of said front and rear sides comprising at least one protruding insert being removably insertable into at least one corresponding hole of the chain hoist for enabling to secure the chain guide in place within the chain hoist, and further comprising a rear edge extending along the outer side of the substantially elongated body and being provided with at least one hook for removably hooking onto at least one corresponding support member of the chain hoist so as to enable to further secure the chain guide in place within the chain hoist;

wherein the substantially elongated body comprises a longitudinal axis, and wherein the middle section of the connecting portion and the open channels of the chain receiving portions are longitudinally aligned with respect to said longitudinal axis of the substantially elongated body;

wherein the first and second shoulders of each chain receiving portion extend on either side of the longitudinal axis of the substantially elongated body so as to each have an offset with respect to said longitudinal axis, the offset of the first shoulder being greater than the offset of the second shoulder;

wherein the shoulders of the chain receiving portions are arched so that the inner side of the substantially elongated body forms a substantially circular profile when curved into the substantially arched configuration;

wherein the shoulders protruding from the inner side of the substantially elongated body define complementary recesses on a corresponding section of the outer side of said substantially elongated body, adjacent to the extremities thereof; and wherein the substantially elongated body, chain receiving portions and connecting portion of the chain guide consist of a single component made by injection molding with nylon PA66 with cold impact additive.

17. A drive mechanism comprising:

a casing;

a first wheel pivotably mounted within the casing and having a bore for receiving a corresponding shaft for driving the same;

a second wheel pivotably mounted within the casing and threadedly engaged with the first wheel for driving the same;

a chain having a segment mounted about the second wheel for driving the same; and a chain guide positioned within the casing for guiding the chain within the chain hoist and about the second wheel, the chain guide comprising:

a substantially elongated body having an inner side and an outer side, along with first and second extremities, the substantially elongated body being made of a substantially flexible material for curving said substantially elongated body into a substantially arched configuration within the chain hoist and about the second wheel receiving the chain;

first and second chain receiving portions provided adjacent to the first and second extremities respectively of the substantially elongated body, on the inner side thereof, each chain receiving portion comprising a pair of shoulders protruding from the inner side of the body and defining an open channel shaped and sized for slidably receiving a portion of the chain; and a connecting portion for operatively interconnecting the first and second chain receiving portions, the connecting portion including a flexible band capable of deforming to allow a passage of a knot or a twist formed along a segment of the chain when passing between the pocket wheel and the connecting portion of the chain guide.

18. A drive mechanism according to claim 17, wherein the connecting portion is made integral to the substantially elongated body, and comprises a middle section positioned between a pair of neighboring sections, the middle section having a width smaller than that of the neighboring sections, and wherein each pair of shoulders comprises first and second shoulders, the first shoulder of each chain receiving portion being wider than the second shoulder thereof.

19. A drive mechanism according to claim 18, wherein each chain receiving portion comprises front and rear sides, the front and rear sides being provided on outer faces of the first and second shoulders respectively of each chain receiving portion, each of said front and rear sides comprising at least one protruding insert being removably inserted into at least one corresponding hole of the chain hoist for enabling to secure the chain guide in place within the chain hoist, and further comprising a rear edge extending along the outer side of the substantially elongated body and being provided with at least one hook for removably hooking onto at least one corresponding support member of the chain hoist so as to enable to further secure the chain guide in place within the chain hoist.

20. A drive mechanism according to claim 19, wherein the substantially elongated body comprises a longitudinal axis, the middle section of the connecting portion and the open channels of the chain receiving portions being longituidinally aligned with respect to said longitudinal axis of the substantially elongated body; wherein the first and second shoulders of each chain receiving portion extend on either side of the longitudinal axis of the substantially elongated body so as to each have an offset with respect to said longitudinal axis, the offset of the first shoulder being greater than the offset of the second shoulder; wherein the shoulders of the chain receiving portions are arched so that the inner side of the substantially elongated body forms a substantially circular profile when curved into the substantially arched configuration; wherein the shoulders protruding from the inner side of the substantially elongated body define complementary recesses on a corresponding section of the outer side of said substantially elongated body, adjacent to the extremities thereof; and wherein the substantially elongated body, chain receiving portions and connecting portion of the chain guide consist of a single component made by injection molding with nylon PA66 with cold impact additive.

* * * * *